US008419042B2

(12) United States Patent
Meindl

(10) Patent No.: US 8,419,042 B2
(45) Date of Patent: Apr. 16, 2013

(54) HEEL ELEVATOR DEVICE FOR A SKI

(75) Inventor: Edwin Meindl, Nikolsdorf (AT)

(73) Assignee: Micado Cad-Solutions GmbH, Lienz (AT)

( * ) Notice: Subject to any disclaimer, the term of this patent is extended or adjusted under 35 U.S.C. 154(b) by 0 days.

(21) Appl. No.: 13/138,319

(22) PCT Filed: Jan. 29, 2010

(86) PCT No.: PCT/EP2010/000554

§ 371 (c)(1), (2), (4) Date: Oct. 21, 2011

(87) PCT Pub. No.: WO2010/086180

PCT Pub. Date: Aug. 5, 2010

(65) Prior Publication Data

US 2012/0025489 A1 Feb. 2, 2012

(30) Foreign Application Priority Data

Jan. 30, 2009 (EP) ..... 09001295
Feb. 26, 2009 (EP) ..... 09153823

(51) Int. Cl.
*A63C 5/00* (2006.01)

(52) U.S. Cl.
USPC ..... 280/604; 280/601; 280/607

(58) Field of Classification Search ..... 280/615, 280/613, 617, 618, 619, 620, 614, 611, 622, 280/623, 601, 607, 11.14
See application file for complete search history.

(56) References Cited

U.S. PATENT DOCUMENTS 4,085,947 A * 4/1978 Sarver ..... 280/607
4,392,666 A * 7/1983 Ramer ..... 280/614
5,560,633 A * 10/1996 McGowan ..... 280/614
(Continued)

FOREIGN PATENT DOCUMENTS

WO 2007/079604 A1 7/2007
WO 2008/083511 A1 7/2008

*Primary Examiner* — John Walters
*Assistant Examiner* — James Triggs
(74) *Attorney, Agent, or Firm* — Knobbe Martens Olson & Bear LLP

(57) ABSTRACT

The present invention relates to a heel elevator device for a ski (120), wherein the heel elevator device (100) is adapted for being fixed to the ski (120) and adapted for connecting a plate element (108) to the ski (120), wherein the plate element (108) comprises a ski binding or a sole of a ski boot. The heel elevator device (100) comprises a supporting element (102) with a supporting section (801), a gravity based positioning element (130) movably supported in the supporting element (102), and a force transmitting piston (805) with a piston engaging section (806). The force transmitting piston (805) is slideably attached to the supporting section (801) in such a way that, when an engagement force is exerted, the force transmitting piston (805) moves slideably into an engagement position. In the engagement position, the piston engaging section (806) is engaged with the gravity based positioning element (130) for fixing the gravity based positioning element (130). When the gravity based positioning element (130) is fixed, the gravity based positioning element (130) is adapted for adjusting the plate element (108) in a fixed minimum climbing angle (α) with respect to the ski (120), and, when the gravity based positioning element (130) is movably supported in the supporting element (102), the gravity based positioning element (130) is adapted for being aligned to gravity.

20 Claims, 17 Drawing Sheets

U.S. PATENT DOCUMENTS

| | | | | |
|---|---|---|---|---|
| 6,290,250 | B1 * | 9/2001 | Karol | 280/618 |
| 6,308,979 | B1 * | 10/2001 | Ludlow | 280/615 |
| 6,655,743 | B1 | 12/2003 | Parizat et al. | |
| 7,246,812 | B1 * | 7/2007 | Ayliffe | 280/615 |
| 7,938,432 | B2 | 5/2011 | Schlegel et al. | |
| 2010/0001491 | A1 | 1/2010 | Schlegel et al. | |
| 2011/0018232 | A1 * | 1/2011 | Prigge et al. | 280/617 |
| 2012/0025489 | A1 * | 2/2012 | Meindl | 280/607 |

* cited by examiner

HEEL ELEVATOR DEVICE FOR A SKI

REFERENCE TO RELATED APPLICATIONS

This application is the U.S. National Phase under 35. U.S.C. §371 of International Application PCT/EP2010/000554, filed Jan. 29, 2010, which claims the benefit of the filling date of the European Patent Application 09 001 295.6, filed Jan. 30, 2009, and the European Patent Application 09 153 823. 1, filed Feb. 26, 2009, the disclosure of which application is hereby incorporated herein by reference.

FIELD OF THE INVENTION

The invention relates to a heel elevator device for a ski and a ski binding system. Moreover, the invention relates to a method of aligning a plate element to a ski.

BACKGROUND OF THE INVENTION

For alpine touring skis specially designed alpine touring bindings are provided. An alpine touring binding is a specialized ski binding with a releasable lock-down heel that may be used for ski touring and backcountry skiing.

During ascent, the skis may be fitted with self-adhesive plush skins to prevent slipping backwards. Thereby, the heels in the ski binding are released to allow moving step by step up the hill. The heels of the ski binding may be fitted with manually adjustable steps to maintain the soles of the ski boots preferably horizontal on a steep climb. When descending, the heels may be fixed with the alpine tour binding to the ski, so that the soles of the boots are parallel to the ski. Descent is then possible by conventional downhill skiing technique.

AT 404 799 B describes a cross-country ski binding suitable for ascent and descent and having a double joint mechanism. The double joint mechanism provides a kinematic that is similar to a natural walking movement. The shoe is connected via a joint located in the vicinity of the shoe tip to a rocker which in turn is mounted in a movable manner on a bearing block with the ski. The bearing block is located in a vicinity of the ball of the foot. A stopper prevents the tilting of the shoe tip in an ascending position and in a descending position.

OBJECT AND SUMMARY OF THE INVENTION

It may be an object of the invention to provide an ergonomically heel elevator device. Moreover it may be an object of the invention to provide a proper load transmission between a heel elevator device and a skier.

In order to achieve the object defined above, a heel elevator device for a ski, a ski binding system and a method of aligning a plate element to a ski according to the independent claims are provided.

According to a first exemplary embodiment of the invention, a heel elevator device for a ski is provided. The heel elevator device is adapted for being fixed to the ski and adapted for connecting a plate element to the ski. The plate element may comprise a ski binding or a sole of a ski boot. The heel elevator device comprises a supporting element with a supporting section, a gravity based positioning element (such as a pendulum element or a rolling body) movably supported in the supporting element and a force transmitting piston with a piston engaging section. The force transmitting piston is slideably attached to the supporting section in such a way that, when an engagement force is exerted, the force transmitting piston moves slideably into an engagement position. In the engagement position, the piston engaging section is engaged with the gravity based positioning element for fixing the gravity based positioning element, wherein, when the gravity based positioning element is fixed, the gravity based positioning element is adapted for adjusting a fixed minimum climbing angle between the plate element with respect to the ski, and, when the gravity based positioning element is movably supported in the supporting element, the gravity based positioning element is adapted for being aligned to gravity (for instance is aligned in accordance with a direction of a gravitational force acting on the gravity based positioning element).

According to a further exemplary embodiment of the invention, the heel elevator device further comprises a connection rod with a first force transmission section and a second force transmission section. The connection rod is rotatably fixed to a receiving section of the plate element and to the supporting section of the supporting element. The first force transmission section is adapted for receiving a climbing force by a force closure from the receiving section and the second force transmission section is adapted for transferring the climbing force by a force closure to the supporting section. The force for slideably moving the force transmitting piston into the engagement position is the (at least a part of the) climbing force. The gravity based positioning element is movably fixed to the supporting element. When the plate element and the ski are rigidly coupled, the gravity based positioning element is fixed to the supporting element and the gravity based positioning element is adapted for fixing the plate element in the fixed minimum climbing angle with respect to the ski. When the plate element and the ski are decoupled, the gravity based positioning element is movably fixed to the supporting element, so that the gravity based positioning element is adapted for being aligned to gravity.

According to another exemplary embodiment, the gravity based positioning element comprises a pendulum element rotatably fixed to the supporting element. When the plate element and the ski are rigidly coupled, the pendulum element is torque proof fixed to the supporting element and the pendulum element is adapted for fixing the plate element in a fixed minimum climbing angle with respect to the ski. When the plate element and the ski are decoupled, the pendulum element is pivotably fixed to the supporting element, so that the pendulum element is adapted for being aligned to gravity.

According to an exemplary embodiment of the invention, the gravity based positioning element comprises a rolling body, wherein the supporting element comprises a rolling surface. The rolling body is rollable along the rolling surface.

According to a further exemplary embodiment, a ski binding system is provided, comprising the above denoted heel elevator device and a ski binding attached to the plate element. The heel elevator device is adapted to be fixed to the ski. The heel elevator device is furthermore adapted to align the plate element to the ski with the fixed minimum climbing angle, wherein the climbing angle depends on an inclination of a hill to which the ski is aligned parallel thereto.

According to a further exemplary embodiment, a method of aligning a plate element to a ski is provided. A force transmitting piston is slidably moved into an engagement position in such a way that a piston engaging section is engaged with a gravity based positioning element, when a climbing force is exerted to the force transmitting piston by the plate element. The gravity based positioning element is spatially fixed by the force transmitting piston in the engagement position for fixing the plate element in a fixed minimum climbing angle with respect to the ski. The minimum climbing angle corresponds to a position of the gravity based positioning element with respect to the supporting element. The force transmitting piston is slidably moved into an disengagement position when a load releasing force is exerted to the plate element in such a way that the piston engaging section is disengaged with the gravity based positioning element, so that the gravity based positioning element is movably fixed to the supporting element. The gravity based positioning element is aligned to gravity in the disengagement position.

According to an exemplary embodiment, the plate element is fixed in a fixed minimum climbing angle with respect to the ski by the gravity based positioning element, when the plate element and the ski are rigidly coupled. When the plate element and the ski are decoupled the gravity based positioning element will be moved (for instance is pivoted), so that the gravity based positioning element is aligned to gravity.

By the term "heel elevator device" an assistance system is described that assists the skier during ascending a hill with alpine touring skis. A heel elevator device may keep the sole of the boots or the plate element horizontal, whereas the skis itself are aligned parallel to the surface of a hill. Thus, the skis are parallel to the inclination of the hill and the soles of the ski boots remain horizontal by means of the heel elevator device. I.e., the skier may ascend the hill like going upstairs a stair. When lifting the heel during a step, the heel elevator device allows moving the heel upwards but prevents the heel from moving back to such a position that the sole of the ski boot is aligned parallel to the inclined ski. I.e., when moving the heel backwards in the direction to the ski, the heel elevator device allows the heel going back in the direction to the ski unless a desired (horizontal) position of the boots sole is achieved. Then the heel elevator device stops the backward motion of the heel so that a (climbing) force may be transmitted from the plate element to the ski for doing the next step. Thus, if the (climbing) force is transmitted from the skier in a desired (horizontal) plane, ascending the hill stepwise may be more agronomical. The heel elevator device may be combined with the plate element and/or a ski binding, in particular with an alpine ski binding.

The term "supporting element" may describe a rigid component, adapted for transmitting a (climbing) force, such as a weight of a skier, from the plate element to the ski. Further on, the supporting element is adapted for fixing and holding mechanical elements of the heel elevator device, such as the gravity based positioning element (pendulum element, roller body, rolling body or ball). The supporting element may comprise a rigid housing, a block or the like consisting of rigid materials such as carbon, composite fibre or any other rigid metallic material. The supporting element may be fixed to the ski, so that the supporting element may be rigidly aligned to the ski and thus to the inclination of a hill.

By the term "roller body" an element is described that comprises generally a mass and that may roll along a surface under the influence of gravity. The roller body may comprise a cylindrical shape, a ball shape or other curved shapes adapted for rolling on a surface and adapted for transferring a force, such as the climbing force.

By the term "pendulum element" a structural element is described that comprises generally a mass attached to a pivot or a rotating axis. The pendulum may accelerate towards an equilibrium position, wherein equilibrium position may be reached when the pendulum is parallel to the direction of gravity. When the pendulum is displaced from the direction of gravity, a restoring force will exert on the pendulum in order to force the pendulum back to the equilibrium position parallel to the direction of gravity. The pendulum may comprise a center of gravity that is spaced from the rotary axis of the pendulum. Therefore, a lever arm between the center of gravity and the rotary axis is provided so that the restoring force will cause the pendulum to move back in its equilibrium position, in particular to a position where the direction of gravity is parallel with the lever arm of the pendulum.

The term "plate element" may describe a plate element comprising a ski binding or a sole of a ski boot.

By the term "rigidly coupled" it may be described that the plate element and the ski are coupled in such a way that no relative movement between the plate element and the ski are provided. I.e., if the plate element and the ski are rigidly coupled, no rotary movement between both may be provided. By the term "decoupled" relative movements between the plate element and the ski may be provided, so that for instance the climbing angle may be changeable and a rotary movement between plate element and the ski is possible.

The term "climbing angle" may describe the angle between the plate element, e.g. the boot sole of a ski shoe, of a binding plate of the ski binding or of the ski binding itself, with respect to the ski. The ski may e.g. lie onto the surface of a hill, wherein the boot sole may be aligned in a horizontal plane. The angle between the surface of the hill and the boot sole may be defined by the climbing angle. When describing a "fixed minimum climbing angle" a limiting climbing angle of relative movement between the plate element and the ski is understood. I.e., the climbing angle defines an angle between the ski and the plate element, where no further movement of the plate element in the direction to the ski is possible. In opposite direction, e.g. in a movement direction of the plate element away from the ski, the movement is not limited or prevented by the meaning of the term "fixed minimum climbing angle".

The term "torque proof" may describe a fixed position of the pendulum element, i.e. that the pendulum element is not pivotable in a torque proof position. I.e. when the pendulum element is torque proof fixed to the supporting element, a rotation around a rotary axis of the pendulum element may be prevented.

A heel elevator device for an alpine touring ski is designed for keeping the soles of ski boots in a predetermined minimum (climbing) angle with respect to the skis that are aligned parallel to the inclination of the hill. Thus, when the skier ascends a hill, his heel may move forward and upward, wherein the backward movement of the heel to the ski is only allowed so long, until a certain climbing angle is achieved. Then the heel elevator device prevents a further backward movement to the ski. Thus, if the back movement of the heel during walking will be limited in a desired position (at a desired climbing angle), advantageously in a horizontal plane, the skier may ascend ergonomically the hill like climbing a stairway. Up to now, the heel elevator device has to be adjusted manually with respect to the inclination of the hill for holding the sole of the ski fixed position in order to achieve an ergonomically profit. When the inclination of the hill is changing, the skier has to readjust the climbing angle, i.e. the limiting angle between the sole of the ski boot and the ski, manually. I.e., the inclination of a hill may change between each step, so that an adjustment of a horizontal position of the ski boot sole is virtually impossible.

By use of the claimed heel elevator device an automatic adjustment of the climbing angle between the plate element, e.g. the sole of a ski boot, with respect to the ski is achieved. By the use of the gravity based positioning element (rolling body, pendulum element), the climbing angle may be readjusted between each step of the skier. When the skier lifts his foot to make a step, the plate element and the ski are (automatically) decoupled, so that the gravity based positioning element is movable. In this status, the pendulum element or the roller body and its center of gravity may be aligned to the direction of gravity, i.e. to the direction to where the gravity acts. Next, when the skier stresses the plate element in order to execute a step, the gravity based positioning element is fixed to the supporting element and now aligned to the direction of gravity. In this status, when the pendulum element is not pivotable anymore or the roller body is not movable anymore, a fixed minimum climbing angle between the plate element and the ski may be provided, so that the ski and the plate element are coupled in this fixed minimum climbing angle and no further backward movement of the plate element to the ski is possible. With other words, in the decoupled status, the gravity based positioning element is movable (e.g. the pendulum element is pivotable), so that the gravity based positioning element aligns itself to gravity, wherein each position of the pendulum element predetermines a respective climbing angle. I.e., if the inclination of the hill raises and the ski is parallel to the inclination, the gravity based positioning element realigns itself to gravity and when a climbing force exerts again to the plate element, the gravity based positioning element is again in contact with the plate element but in a different position. Thus, a new climbing angle is provided that may be a result of the different position where the gravity based positioning element gets in contact with the plate element, e.g. the ski boot sole.

By adjusting the climbing angle between each step, a nearly permanent horizontal position of the plate element, i.e. the ski boot sole or the ski binding, may be provided, so that a more ergonomically heel elevator device may be provided. Time-consuming and long-winded manual adjustment proceedings to adjust the climbing angle to changed inclinations of the hill may be prevented. Hence, a more comfortable and ergonomic ascending on a hill may be possible by the use of the present claimed heel elevator device.

In an exemplary embodiment, the force transmitting piston may be attached slideably e.g. in the direction of the climbing force and in the direction of the load releasing force, so that the force transmitting piston may move along a first direction when the engagement force, e.g. the climbing force, acts and when the load releasing force acts the force transmitting piston may move along a second (opposite) direction. In particular, when the force transmitting piston receives the climbing force, e.g. from the connection rod or from a strut element, the transmitting piston moves along the first direction into the engagement position and thereby engage with its piston engagement section the gravity based positioning element, so that the gravity based positioning element is fixed (e.g. the pendulum element is rotatably fixed). When the load releasing force acts to the force transmitting piston and the plate element and the ski are decoupled, the force transmitting piston moves in the second direction and thereby release with its piston engaging section the gravity based positioning element, so that the pendulum element is movable or rotatable again.

When providing the connection rod according to an exemplary embodiment, the climbing force or at least a part of the climbing force may be transferred from the plate element to the supporting element by the connection rod instead of the pendulum element. Thus, the pendulum element or the rolling body may be constructed with a less weight. Moreover, the connection rod may be supported rotatably to the receiving section and the supporting section by rotary pins. The connection rod furthermore comprises the first and second transmission sections by which the climbing force may be transferred. The first transmission section and second transmission section may form a first surface and a second surface of the connecting rod, which may form a physical contact to the receiving section and/or the supporting section. Thereby, the climbing force may be transferred by the physical contact of the first surface and second surface and not by the rotary pin. Thus, the rotary pins may be constructed with a less weight, because the rotary pins may only be used for rotatably supporting the connection rod and not for transferring the climbing force. Thus, a proper load transmission between the heel elevator device and a skier is achieved, because most of the climbing force is transferred by the connection rod to the supporting element and not by the gravity based positioning element.

The piston engagement section may be formed with piston recesses into which a coign or a step shaped surface of an engagement element of the pendulum element or the rolling body may be engaged. The engagement section may also be formed with a coign or a step shaped surface into which a recess of the engagement element may be engaged.

According to a further exemplary embodiment, the heel elevator device comprises a fixation device. When a climbing force is exerted to the plate element in a direction to the ski, the fixation device is adapted for providing a torque proof fixation to the gravity based positioning element. When a load releasing force is acting to the plate element, e.g. in an opposite direction to the ski, the fixation device is adapted for providing a movable (pivotable) fixation of gravity based positioning element (the pendulum element).

By the term "climbing force" a force may be described that is exerted on the plate element in the direction to the ski for instance due to the weight of the skier when exerting a step. The term "load releasing force" describes the force that may decouple the plate element and the ski, for instance due to the weight of the ski or/or due to lifting the ski boot by the skier. I.e. if the skier lifts its foot and the climbing force is not longer exerted to the plate element, the ski will e.g. lift off from the hill surface. Then, the weight of the ski may generate the load releasing force, so that the plate element and the ski are decoupled and the pendulum is pivotable.

Thus, by the exemplary embodiment, the fixation device is adapted for fixing the ski and the plate element in a coupled status and releases the plate element from the ski in a decoupled status. Thus, an automatic coupling and decoupling mechanics may be provided by the fixation device.

According to a further exemplary embodiment, the fixation device comprises a bolt, wherein the bolt is fixed to the supporting element. The fixation device may be mechanically realized for instance by bolts, to which the pendulum device abuts on during the coupling state and to which the pendulum is released in a decoupled state so that a rotary movement of the pendulum device is enabled. By using the bolts, the bolts may be aligned to the pendulum element in such a way, that when the climbing force is exerted to the pendulum element and thereby to the bolts, friction between the bolts and the pendulum element is provided, so that a rotary movement will be prevented and the ski and the plate element are rigidly coupled. When the rotary movement between the plate element and the ski is provided, also a change in the climbing angle is provided.

According to a further exemplary embodiment, the bolts may be designed elastically. Thus the bolts may provide a damping effect, for instance in the direction to the gravity. I.e. if the skier steps abruptly in the plate element so that the climbing force rises very abruptly, the exerted climbing force may be damped by the elastic bolts. Thus, abrasive wear between the pendulum element and the bolts may be reduced. Further on, by providing a damping effect by the elastic bolts, each step may furthermore cushioned or absorbed so that a more comfortable sense for the stepping skier may be provided.

According to a further exemplary embodiment, the heel elevator device further comprises a floating pin for pivotably supporting the pendulum element. The floating pin may be adapted for floatably fixing the pendulum element, so that, when the climbing force is exerted, the pendulum element is moved in the direction to the fixation device for being torque proof and, when the load releasing force is exerted, the pendulum element is moved away from the fixation device, so that the pendulum element is pivotable. I.e. a movement of the pin due to the climbing force or the load releasing force may be provided in the movement of the floating pin and the pendulum element to or away the fixation device. I.e., in case the fixing device comprises bolts, the pendulum element may be moved by the climbing force in the direction to the bolts, so that a contact between the pendulum element and the bolts occurs. Thus, between the pendulum element and the bolts a friction force may be provided so that a rotary movement of the pendulum element may be prevented. In case that the load releasing force is exerted, the floating pin and the pendulum element may move away from the fixation device, such as the bolts, so that only a slidable contact or no contact is provided and thus no friction force between the pendulum element and the bolt exits. In this case, the pendulum element is able to be removed rotatably, for instance due to gravity. Thus, the fixation device provides an automatic fixing mechanism for the rotary movement of the pendulum element without the need of complex mechanical elements. Furthermore, the fixation device provides an ergonomic controlling of the change between the torque proof status and the movable status of the pendulum device, because the fixation device and the floating pin automatically keep the pendulum element torque proof, when a climbing force due to a step of the skier is exerted, and release automatically the pendulum element for pivotably movement due to a lifting of a foot of a skier. Thus, a fixing and releasing of the pendulum element with respect to a natural and ergonomically course of movement may be provided. Thus, a complex control system for keeping the pendulum element pivotably or torque proof may be prevented.

According to a further exemplary embodiment, the heel elevator device further comprises an elastic bearing ring, wherein the pendulum element is mounted floatably to the floating pin by the elastic bearing ring. Thus, if the floating pin is rigidly fixed to the supporting element, by the elastic bearing ring a floating support of the pendulum element may be provided. The elastic bearing ring is squeezable when the climbing force is acting, so that the pendulum element is enabled to move in the direction to the fixation device and is thus torque proof. When no climbing force is exerted and the load releasing force is exerted, the elastic bearing ring expands again and the pendulum element automatically moves away from the fixation device and is thus pivotable again. Thus, even if the floating pin is rigidly fixed to the supporting element a floating support may be provided. Furthermore, the use of an elastic bearing ring provides an incomplex and inexpensive solution for moving the pendulum element without any complex drive assemblies or drive mechanisms for a pin connection, such as spring mechanisms or electrical mechanisms.

According to a further exemplary embodiment, the heel elevator device further comprises a vibration absorber device. The vibration absorber device is adapted for absorbing a vibration of the gravity based positioning element. When the gravity based positioning element is in the decoupled status and movable (pivotable) for being aligned to gravity, the gravity based positioning element tends to roll or swing back and forth under the influence of the restoring force of the gravity over its center position, i.e. over the position where the gravity based positioning element is aligned to the direction of gravity. Thus, the vibration absorber device reduces the oscillation of the gravity based positioning element over the equilibrium position of the gravity based positioning element. The vibration absorber device may comprise a spring device that reduces the swinging velocity of the gravity based positioning element. Furthermore, also foam or other elastic or squeezable materials may be used to absorb the swinging velocity of the pendulum device. Thus, when the plate element and the ski are decoupled and the pendulum is pivotable in order to being aligned to gravity the time that the gravity based positioning element needs to align to gravity may be reduced because the oscillation time of the gravity based positioning element for aligning to gravity may be reduced. Thus, the time for aligning the gravity based positioning element to gravity may be reduced, so that the step frequency of the skier may be reduced, for example. Thus, even if the skier steps fast up to the hill and his step frequency is very short, the gravity based positioning element may be still aligned to gravity also in a short decoupling state. The vibration absorber device may be applied to gravity based positioning elements comprising the pendulum element or the roller body.

According to a further exemplary embodiment, the vibration absorber device comprises an isolated chamber. The isolated chamber is adapted for surrounding at least a part of the gravity based positioning element, wherein the isolated chamber comprises a fluid. The fluid may comprise pneumatic fluids, such as air, or hydraulic fluids, such as oil. When the gravity based positioning element swings or rolls through the fluid in the isolated chamber, a damping effect of the vibrations and the rotary movement may be provided. The fluids may exert a damping or braking force in the opposite direction to the movement direction of the gravity based positioning element. Thus, a vibration absorber device without any wear and tear parts, such as springs or foam, may be provided and the lifetime of the heel elevator device may be extended. The fluid may comprise oily fluid and/or antifreeze fluids.

According to a further exemplary embodiment, the pendulum element comprises an engagement section, wherein the engagement section is adapted for being fixed to a receiving section of the plate element. The engagement section provides a rigid angle with respect to the receiving section. I.e., the ski and the plate element are decoupled and the pendulum element is pivoted due to the gravity, so that also the climbing angle may be realigned. Then, if the ski and the plate element are decoupled again, independent on the new aligned climbing angle, the ridged angle between the engagement section and the receiving section will be constant. With other words, for a variety of different climbing angles, the rigid angle may be kept constant. I.e., if the rigid angle between the receiving section and the engagement section is kept constant, the position of the plate element relative to the ski will also be aligned to the direction of gravity. With other words, if the direction of gravity is vertical and the plate element shall be aligned to a horizontal position, the rigid angle between the extending direction of the pendulum element and the plane of the plate element may be around 90° degree. If the inclination of the hill and thus the position of the ski are changed, the climbing angle is changed also by pivoting the pendulum element. The pendulum element will also align itself to a vertical direction, so that even for the changed climbing angle, rigid angle will be around 90° degree and plate element is aligned to the horizontal position again.

The engagement section may comprise a flange that may get in contact with a respective receiving groove in the receiving section for fixing the plate element relative to the pendulum element in the rigid angle. The rigid angle between the pendulum element and the plate element may be provided by differently located receiving sections, e.g. receiving grooves, in the plate element to which the engagement section of the pendulum element may be engaged under the same rigid angle. Due to a different climbing angle, a predetermined receiving groove may be engaged by the engagement section. Thus, by providing an engagement section that is adapted for being fixed to a variety of different locations to the plate element by keeping a rigid angle constant, a connection or engagement system may be provided without any complex adjustment mechanics.

According to a further exemplary embodiment, the pendulum element comprises an alignment pendulum and a support pendulum. The alignment pendulum and the support pendulum are coupled. The alignment pendulum is adapted for being aligned to gravity, wherein the support pendulum is adapted for fixing the plate element in a fixed minimum climbing angle with respect to the ski. Thus, the pendulum elements may be divided into two functional pendulums, namely the alignment pendulum and the support pendulum. Each of the pendulum elements may be optimized due to its functions. For instance, the supporting pendulum may be designed in a strong and rigid manner in order to absorb and transmit the climbing force, which can be for instance the weight of a grown up skier and may be strong enough to transmit the climbing force from the plate element to the ski. Furthermore, the support pendulum may be designed for aligning the climbing angle between the plate element and the ski. On the other side, the alignment pendulum may be designed lighter than the support pendulum, because the alignment pendulum has to be adapted for being aligned to gravity and may not be adapted for transmitting the climbing force, for instance. Thus, an optimized weight-to-function ratio may be designed, so that the overall weight for the heel elevator device may be reduced. Especially for alpine touring binding the weight factor is an important factor to improve the ergonomics and the comfort.

The supporting pendulum and the alignment pendulum may be coupled in such a way, that each of the alignment pendulum and supporting pendulum exert a common rotary movement, so that when the alignment pendulum pivots for being aligned to the direction of gravity, also the support pendulum will be aligned to gravity by the alignment of the alignment pendulum. With other words, the pendulum element and the supporting element are coupled in such a way, that a rotation of one of the pendulums leads to a rotation of the respective pendulum.

According to a further exemplary embodiment, the alignment pendulum comprises a first fixation section with a first rotary axis and a weight section. The alignment pendulum is fixed to the supporting element pivotable around the first rotary axis. The center of gravity of the alignment pendulum is located in the weight section for providing a lever arm with respect to the first rotary axis. Thus, by the described exemplary embodiment of the alignment pendulum, the center of gravity of the alignment pendulum is spaced apart from the first rotary axis. Thus, the lever arm between the center of gravity of the alignment pendulum and the first rotary axis leads to a rotary motion and to an alignment to gravity of the alignment pendulum. By increasing the lever arm, the force that causes the pendulum to align to gravity will be increased and the alignment characteristics may be improved. Furthermore, weight of the alignment element may be reduced because in the first fixation section of the alignment pendulum material may be reduced in order to provide the center of gravity more in the weight section.

According to a further exemplary embodiment, the vibration absorber device is adapted for completely enveloping the alignment pendulum. The oscillation of the alignment pendulum when aligning to gravity acts negative to the alignment time, so that the vibration absorber device has to act on the alignment pendulum. Thus, the vibration absorber device may completely enclose the alignment pendulum for damping the oscillations. I.e. the insulated chamber may surround the alignment pendulum completely, whereas the supporting pendulum may be located outside the insulated chamber. Thus, in case that the vibration absorber device is operated with liquid fluid, such as oil, an easier sealing of the chamber may be provided because only a few coupling elements have to exit insulation chamber for coupling the supporting pendulum to the alignment pendulum.

According to a further exemplary embodiment, the alignment pendulum comprises a weight element in the weight section. Thus, the center of gravity may be spaced apart from the first rotary axis and the lever arm will be increased, so that the rotary moment due to gravity may be increased. Thus, if the rotary moment is increased, the alignment pendulum may also transmit an increased rotary movement to the supporting pendulum. Thus, if the supporting pendulum is heavier or wedged, an increased rotary moment may be transferred to the supporting pendulum for rotating the same even if the alignment pendulum is designed lightweight.

According to a further exemplary embodiment, the supporting pendulum comprises a second fixation section with a second rotary axis and the engagement section for being engaged with the plate element. The supporting pendulum is fixed to the supporting element pivotable around the second rotary axis. A center of gravity of the supporting pendulum is located in the second fixation section. Thus, if the center of gravity of the supporting pendulum is located close to the second rotary axis, a small rotary movement transmitted by the alignment pendulum may force the supporting pendulum to rotate. Between the engagement section and the plate element the constant rigid angle may be provided, so that when the position of the supporting pendulum is changed relatively to the ski, also the position of the plate element relatively to the ski is changed either.

According to a further exemplary embodiment, the alignment pendulum and the supporting pendulum are coupled magnetically. This may be provided by placing magnets to the alignment pendulum and the supporting pendulum, wherein the magnets gravitates towards each other and the rotary moment from the alignment pendulum may be transmitted to the supporting pendulum. Thus, no mechanical connection between the alignment pendulum and the supporting pendulum is necessary. Furthermore, if the alignment pendulum is surrounded by the insulating chamber of the vibration absorber device, an improved and easier isolation may be provided, because no mechanical coupling parts have to be guided outside the insulating chamber. Furthermore, an easier exchange of defect parts, such as the exchange of a defect supporting pendulum or alignment pendulum, may be provided, so that maintaining time and costs may be reduced.

According to a further exemplary embodiment, the heel elevator device further comprises a decoupling device. The decoupling device is adapted for decoupling the alignment pendulum and the supporting pendulum when activating the decoupling device. In case that the skier rests in a permanent position on the hill, it may be possible that the relative position between the supporting pendulum and the alignment pendulum will be changed, so that the support pendulum is not longer aligned to the alignment pendulum. Thus, when moving on to ascend the hill, the coupling of the supporting pendulum and the alignment pendulum may be released by the decoupling device, so that the supporting pendulum and the alignment pendulum may be readjusted with respect to each other. Furthermore, by the decoupling device, a desired relative position between the supporting pendulum and the alignment pendulum may be adjusted, i.e. a preferred rigid angle between the plate element and the ski may be adjusted. Thus, while the alignment pendulum will always be aligned to gravity, the relative position to the supporting pendulum may be changed by decoupling both pendulums by the decoupling device and the position of the supporting pendulum with respect to the alignment pendulum may be changed individually. Thus, if a skier prefers to have a plate element position not parallel to the horizon when stepping up the hill, a different preferred plate element position, other than a horizontal position, may be adjusted. The adjusted position that is provided by a defined alignment between the alignment pendulum and the supporting pendulum is always readjusted between the steps due to the alignment of the alignment pendulum due to gravity.

The decoupling device may comprise coupling elements, or for instance a plate that is adapted for being interposed between the alignment pendulum and the supporting pendulum when a magnetic coupling is used, for instance.

According to the further exemplary embodiment, the heel elevator device further comprises a plate element adapted for being fixed pivotable to the supporting element. The plate element comprises the receiving section. The receiving section is adapted for engaging the engagement section of the pendulum element, wherein the engagement section is adapted for being engaged in the receiving section when the climbing force is exerted, so that the pendulum element is torque proof fixed. The receiving section is adapted for engaging the engagement section in different positions relative to different climbing angles, wherein for each different engaging position, a constant rigid angle will be provided. The plate element may comprise the complete foot sole of the ski boot, so that a broader transmission of the climbing force may be provided.

According to a further exemplary embodiment, the heel elevator device further comprises a retaining spring. The retaining spring is attached between the supporting element and the force transmitting piston in such a way, that, when the load releasing force is exerted, the force transmitting piston moves slidably into a releasing position. In a releasing position, the piston engaging section is decoupled of the gravity based positioning element, so that the gravity based positioning element is pivotable. I.e., when the climbing force is exerted to the force transmitting piston, the force transmitting piston may move to the direction of the gravity based positioning element and thereby acts in counterdirection to the spring force of the retaining spring. When the load releasing force is exerted, the force transmitting piston may be moved by the retaining spring away from the gravity based positioning element (e.g. from the engagement element of the pendulum element) and thereby decoupling the engaging section of the force transmitting piston and the gravity based positioning element. Thus, it may be ensured, that, when the load releasing force is exerted, gravity based positioning element may be decoupled easily by help of the retaining spring.

According to a further exemplary embodiment, the pendulum element is rotatably fixed to the supporting element in such a way that, when climbing force is exerted, the engagement element is in frictional contact with the supporting element, and, when the load releasing force is exerted, a gap between the engagement element and the supporting element is provided.

The pendulum element may be supported floatably (springy or elastically), e.g. by the floating pin, so that when the climbing force act, the pendulum element moves in the direction of the supporting element and thereby generates a physical contact to the supporting element for transmitting the climbing force. In other words, the climbing force or a part of the climbing force is transmitted by the physical contact and not by the supporting pin or the floating pin of the pendulum element. Thus, the supporting pin and/or the floating pin may be formed more lightweight because fewer loads will act on the pendulum element, in particular on the supporting pin or floating pin. Moreover, a further prevention from an undesired rotation of the pendulum element may be achieved due to the additional frictional contact of the pendulum element with the supporting element. When load releasing force acts, the pendulum element may move away from the supporting element, so that the gap (e.g. 0.2 to 0.3 mm (Millimeter)) may provided and no frictional contact is provided. Thus, the pendulum element may be rotatable again.

According to a further exemplary embodiment, the force transmitting piston comprises a sealing ring. When the force transmitting piston is formed for instance circular or elliptical a sealing ring may be attached, so that the sealing ring may prevent an entering of dust particles in the inside of the heel elevator device.

The force transmitting piston is formed for instance circular or elliptical and the sealing ring may easily be attached, so that the sealing ring may prevent an entering of dust particles in the inside of the heel elevator device. Moreover, the sealing ring may seal the supporting section from the environment, so that e.g. fluids inside the supporting section are kept inside the supporting section, even during movement of the force transmitting piston.

According to a further exemplary embodiment, the pendulum element comprises a first pendulum part, a second pendulum part and a pendulum rod. The first pendulum part and the second pendulum part are rotatably fixed to the supporting element. The first pendulum part and the second pendulum part are connected by the pendulum rod. The engagement element is fixed to the pendulum rod.

The pendulum element may be formed as a rigid part or as described in the above mentioned exemplary embodiment with a first pendulum part, a second pendulum part and a pendulum rod. The first pendulum part and the second pendulum part may be rotatably fixed to the supporting element, wherein the pendulum element connects both pendulum parts provides the same rotation movement. Thus, each pendulum part may be connected to outer surfaces of the supporting element and envelopes e.g. the force transmitting piston, wherein the pendulum rod extends through the center of the supporting element for connecting both pendulum parts. In the center of the supporting element, the pendulum rod may comprise the engagement element, so that the engagement element may be placed inside the supporting element, wherein the pendulum parts may be connected outside of the supporting element. Furthermore, the pendulum rod may be formed from carbon fibre, for instance, and may provide springy characteristics.

According to a further exemplary embodiment, the heel elevator device further comprises a strut element. The strut element is adapted for being engaged to the plate element for transmitting the climbing force. The strut element is attached rotatably around a strut rotating axis to the supporting element in such a way, that, when exerting the climbing force, the strut element is adapted for rotating with a strut rotary movement around the strut rotating axis and the strut element is adapted for transmitting at least a part of the climbing force to the connection rod. The strut element may comprise a lever arm made from composite materials or of a metal. The strut element may form a connection between the plate element and the supporting element, so that when the climbing force is exerted the pendulum element is rigidly coupled. When the load releasing force is exerted, the strut element is adapted to be decoupled from the plate element, so that no further force is transmitted to the connection rod and so that the pendulum element may be decoupled and pivotable. The strut element may be attached to the supporting element e.g. by a bolt connection including the strut rotating axis. The strut rotating axis may be located at the supporting element in such a way, that, when moving the strut element by the strut rotary movement around the strut rotating axis due to the climbing force, the strut rotary movement transmits a part of the climbing force to the connection rod. Another part of the climbing force, in particular the larger part of the climbing force, may be transmitted to the bolt in the strut rotating axis. Thus, by transferring a (smaller) part of the climbing force to the connection rod by the strut rotary movement, damage of the smaller mechanical parts of the heel elevator device, such as the pendulum element or the force transmitting piston, may be prevented.

Moreover, the strut element may bridge a distance between the supporting element and the plate element, so that no direct contact between the plate element and the supporting element may be provided. Thus, the climbing force may be transmitted with a certain distance to the rotary axis of the plate element. I.e. when the rotary axis of the plate element is located in the vicinity of the toes of the ski driver, the supporting element and the strut element may be located in the vicinity of the heel of the ski driver. The larger distance between the supporting element and the plate element in a distance to the rotary axis of the plate element may be bridged by the strut element. Thereby, even large climbing forces, for instance climbing forces by a weight of a heavy weight ski driver, may be transmitted to the supporting element more efficient.

According to a further exemplary embodiment, the heel elevator device further comprises a guiding element and a first spring attached to the guiding element. The guiding element is attached rotatably around the strut rotating axis to the supporting element. The guiding element is adapted for providing a guiding rotary movement when the plate element moves in the direction to the supporting element and engages the guiding element. The first spring is adapted for exerting a climbing force to the strut element in such a way, that the guiding rotary movement of the guiding element forces the strut element to conduct the strut rotary movement until the strut element is engaged with the plate element. The guiding element may provide a curvic shape, whereby along the curvic shape the plate element may move along when the climbing force is exerted. Thus, the movement of the plate element forces the guiding element to conduct the guiding rotary movement, whereby the guiding rotary movement is defined by the curvic shape. When the guiding element conducts the guiding rotary movement, a spring force of the first spring forces the strut element to provide the strut rotary movement. The strut element rotates around the strut rotating axis until the strut element is engaged to the plate element. With other words, the plate element moves the guiding element, whereby by the guiding rotary movement of the guiding element the strut element may conduct the strut rotary movement around the strut rotating axis until the strut element provides the desired position and is coupled to the plate element. Then, when the strut element is in the desired position and coupled to the plate element, the climbing force may be transmitted to the connection rod and the supporting element. With other words, the guiding element is adapted for bringing the strut element in a desired and predetermined position, so that always a correct coupling of the strut element with the plate element may be provided.

When the load releasing force is acting, the plate element and the strut element as well as the guiding element are decoupled. Thus, the retaining spring forces the force transmitting piston to move in a direction adapted for decoupling the pendulum element. Thereby, the movement of the force transmitting piston forces the strut element to rotate in counter direction of the strut rotary movement around the strut rotating axis. The strut element rotates into a start position in counter direction of the strut rotary movement. At the same time by the first spring, the rotation of the strut element forces also the guiding element to move in a counter direction to the strut rotary movement until a start position is reached again. The start position may be defined by a stopper element for instance.

According to a further exemplary embodiment, the plate element comprises a stopper region, wherein the stopper region is adapted for being in contact with the ski at a maximum climbing angle for preventing further rotation of the plate element. Thus, by the stopper section of the plate element, a tilting of the plate element may be prevented so that a more ergonomic stepping may be provided. With other words, the stopper section may be a limiting factor for the movement of the plate element in the direction away from the ski and thus defines a maximum climbing angle. The stopper section may be provided for instance by a flattening surface at the plate element.

According to a further exemplary embodiment of the heel elevator device, the gravity based positioning element comprises the rolling body, in particular a ball, wherein the supporting element comprises a rolling surface. The rolling body is rollable along the rolling surface. Thus, a rolling body is more resilient in comparison to a rotatably supported pendulum element, so that a proper load transmission between the heel elevator device and a skier is achieved.

The term "rolling surface" denotes a surface onto which the rolling body is rollable, wherein the rolling surface comprises an inclination. The rolling body that is rolling along the surface reduces by the inclination of the rolling surface its distance or raises its distance to a certain position of the force transmitting piston. Thus, a defined position of the force transmitting piston in an engagement position is defined.

An "engagement position" of the force transmitting piston with respect to the supporting element is defined by the position of the rolling body on the rolling surface. The position of the rolling body on the rolling surface is defined by the direction of the gravity. Thus, when the ski and the hill inclination changes, also the rolling surface changes its position, so that the rolling body rolls to another position on the rolling surface. Thus, the engagement position of the force transmitting piston changes and is amended to the new position of the rolling body on the rolling surface.

According to a further aspect of the present invention, the supporting section comprises a liquid tight chamber in which the rolling body and a part of the force transmitting piston is embedded. By the an exemplary embodiment, the liquid tight chamber prevents dust particles from moving inside in the supporting section and affecting negatively the rolling body and the part of the force transmitting piston.

According to a further exemplary embodiment, the heel elevator device further comprises the sealing ring, wherein the sealing ring is mountable to the supporting section or to the force transmitting piston in such a way, that the sealing ring seals the liquid-tight chamber.

According to a further exemplary embodiment, the liquid tight chamber comprises a fluid for damping a movement of the rolling body and/or the force transmitting piston.

When the rolling body is movable inside the supporting section, the rolling body rolls fast due to gravity force. Thus, the rolling body would be rebounded from the walls of the supporting section and vibration would occur. By damping the movement of the rolling ball by a fluid, the speed of the rolling body is reduced and damped. In particular, if the speed of the rolling body is too high when the rolling body aligns to gravity, the rolling body would overreach the balance position. If the speed of the rolling body is damped and reduced by the fluid, the overreaching of the aligned gravity position is reduced, so that a more exact alignment of the rolling body of respective gravity is achievable.

In particular, the fluid comprises a defined viscosity. The viscosity is a measure of the resistance of the fluid, wherein the viscosity may be defined by the SI physical unit of dynamic viscosity ($[n]=Ns/m^2=Pa\cdot s$). The fluid may comprise a viscosity of approximately 1 mPa·s to approximately $10^6$ mPa·s. The fluid may comprise water (approximately 1 mPa·s) or a paraffin oil (approximately $10^2$ mPa·s to approximately $10^6$ mPa·s). The fluid may comprise antifreeze characteristics wherein its liquid to solid phase boundary is defined under normal pressure by a temperature between −10° Celsius to −50° Celsius.

According to a further exemplary embodiment the supporting section comprises a compensation element. The compensation element is located inside the liquid tight chamber. The compensation element is adapted for being compressed by the force transmitting piston for amending a fluid volume of the compensation element itself and thus of the liquid tight chamber. In particular, more material or mass of the piston is introduced inside the liquid tight chamber, when the force transmitting piston moves further inside the liquid tight chamber. This additional mass of the force transmitting piston sets the fluid under pressure, if the volume of the liquid tight chamber is kept unchanged. In order to counteract against the pressure increase, the compensation element reduces its volume with the same amount as the force transmitting piston increases its volume inside the liquid tight chamber. On the other side, when the force transmitting piston moves outside of the liquid tight chamber, a low pressure inside the liquid tight chamber occurs because less mass is inside the liquid tight chamber. Thus, in order to counteract the low pressure, the compensation element is adapted to increase its volume. Hence, by the compensation element, the volume change inside the liquid tight chamber, which occurs by the movement of the force transmitting piston, is balanced by the compensation element.

The compensation element may comprise an elastic foamed material, an elastic deformable material, such as rubber, or a deformable air cushion.

According to a further exemplary embodiment, the supporting section comprises a through-hole connecting the inside of the liquid tight chamber to the outside. The through-hole is adapted for supporting the force transmitting piston slideably. The sealing ring is interposed between the force transmitting piston and the through-hole. Around the force transmitting piston, in particular around the piston rod of the force transmitting piston, the sealing ring is attached and seals the liquid tight chamber to the outside. The force transmitting piston may be slideably with respect to the sealing ring or the sealing ring may be slideably with respect to the inner wall of the through-hole.

According to a further exemplary embodiment of the present invention, the piston engaging section comprises piston recesses for engaging the rolling body in the engagement position. Depending on the relative position of the rolling body with respect to the force transmitting piston, the rolling body is engageable with an assigned one of the piston recesses. The piston recesses are aligned in the engaging section in such a way that depending on an engagement of the rolling body with an assigned piston recess the relative position of the force transmitting piston with respect to the supporting element is defined.

In other words, when the rolling body is aligned to gravity, the rolling body takes a predefined position in the supporting section. For each predefined position of the rolling body, an assigned recess in the piston engaging section is defined and thus an assigned position of the force transmitting piston with respect to the supporting section is defined. Moreover, the rolling body couples in the predefined position the assigned recess to a certain position on the rolling surface, so that a defined position of the force transmitting piston depending on the position of the rolling body is defined.

According to a further exemplary embodiment, the heel elevator device further comprises a retainer, wherein the retainer is rotatably connected to the supporting element and rotatable around a retainer rotating axis. The retainer is adapted for being engaged to the plate element for transmitting at least a part of the climbing force from the plate element to the supporting element. When the retainer is connected to the supporting element and is engaged with the plate element, the climbing force may be at least partially transferred from the plate element to the supporting element. Moreover, the retainer fixes a predefined position of the supporting element with respect to the plate element. Thereby, the fixed minimum climbing angle is defined. The retainer is furthermore coupled to the force transmitting piston in such a way, that the position of the retainer with respect to the supporting element and/or to the plate element is adjustable by the position of the force transmitting piston and thus by the alignment of the rolling body inside the supporting element.

The retainer is rotatably connected to the supporting element e.g. by a bolt connection. The retainer is connected to the supporting element that the most part or all of the climbing force is transferred by the bolt connection to the supporting element. By the force transmitting piston, only the engagement force may be transferred which is originate e.g. by a spring force (of a further spring as described below) or by the weight of the force transmitting piston itself. Thus, a proper load transmission between the heel elevator device and the skier is achieved, because most of the climbing force is transferred by the resilient bolt connection to the supporting element and not by the force transmitting element and the rolling body.

According to a further exemplary embodiment, the force transmitting piston is coupled to the retainer in such a way that the position of the retainer with respect to the supporting element is adjusted by the position of the force transmitting piston in the engagement position. The force transmitting piston functions such as a pitch arm. The force transmitting piston may be coupled rotatably to the retainer without a providing a relative longitudinal movement with the retainer. Hence, in the engaged position, the rolling body defines a relative position of the force transmitting piston and the force transmitting piston defines a relative position of the retainer with respect to the supporting element.

According to a further exemplary embodiment, the plate element comprises the receiving section with at least two recesses. The recesses are adapted for engaging the retainer. Depending on the position of the retainer with respect to the supporting element, the retainer engages with an assigned one of the recesses.

According to a further exemplary embodiment, each of the recesses comprises a guiding surface, wherein the guiding surface is formed in such a way that during engagement of the retainer with an assigned one of the recesses and before the climbing force is exerted from the plate element to the retainer, the retainer is rotatable around the retainer rotating axis.

In particular, when the force transmitting piston and the rolling body are engaged in the engagement position, a predefined position of the retainer is adjusted. The predefined position is dependent on the position of the gravity aligned rolling body. Dependent on the predefined position of the retainer, the retainer engages with one of the recesses. When the retainer engages one assigned recess, firstly the retainer contacts the guiding surface. Due to the movement of the plate element when the skier steps onto the plate element, the plate element moves further in the direction to the retainer and the guiding surface forces the retainer to move (rotate) to the guiding surface in the direction to the plate element until a predefined end position is reached. In the end position, the plate element, the retainer and the supporting element are rigidly connected to each other in such a way that a further down movement of the plate element in the direction to the retainer or the supporting section is not longer possible and the climbing force is transferrable. In the end position, the predefined climbing angle is adjusted. In other words, each recess is formed in such a way that each recess defines a predefined end position of the retainer and thus a predefined climbing angle when the retainer is engaged with an assigned one of the recesses.

According to a further exemplary embodiment, the retainer comprises a long hole with a guide slot, wherein the force transmitting piston is coupled slideably to the guide slot. The guide slot is formed in such a way that a movement of the force transmitting piston in the guide slot in the direction to the supporting element is limited. Moreover, the guide slot is formed in such a way that by a movement of the retainer in the direction to the plate element, the guide slot lifts the force transmitting piston for decoupling the force transmitting piston with the rolling body. If the retainer and the force transmitting piston do not provide a relative longitudinal movement between each other, the rotation of the retainer away from the plate element is possible, until the force transmitting piston is engaged with the rolling body. Thus, the rotation of the retainer away from the plate element is limited by the force transmitting piston. When the force transmitting piston is coupled slideably to the guide slot, the retainer may rotate away from the plate element and is not limited by the force transmitting piston. If the force transmitting piston reaches its engagement position with the rolling body, the retainer may rotate further away from the plate element because a relative longitudinal movement of the force transmitting piston along the guide slot of the retainer is possible. Thus, no undesired blockage by the force transmitting piston during the disengagement of the plate element and the retainer occurs.

Moreover, when the retainer is rotated in the direction to the plate element, the guide slot, e.g. an offset in the guide slot, lifts the force transmitting piston into the releasing position. In particular, the guide slot is formed in such a way that e.g. the offset in the guide slot lifts the force transmitting piston when the retainer contacts already the assigned guiding surface of an assigned recess. Thus, in an engagement position of the retainer with the plate element it is ensured by the (offset of the) guide slot that the force transmitting piston is decoupled with the rolling body.

The guide slot may also comprise an insert that is detachably inserted in the guide slot, so that the position, at which rotation position caused by the rotation of the retainer the force transmitting piston is lifted by the insert. The insert may be formed adjustable with respect to the location in the guide slot.

According to a further exemplary embodiment, the heel elevator device further comprises a torsion spring connected to the supporting element, wherein the torsion spring is adapted for exerting a torsional force to the retainer for rotating the retainer around the retainer rotating axis. The torsion spring is connected in such a way that when the plate element and the retainer are engaged, the torsion spring is prestressed, wherein the prestressed torsional force try to force the retainer to rotate away from the plate element. If the plate element is lifted by the skier, the plate element and the retainer begin its decoupling process, wherein the prestressed torsion spring forces the retainer to rotate away from the plate element. Thus, the decoupling process may be improved.

According to a further exemplary embodiment, the heel elevator device further comprises a further spring, wherein the further spring is connected between the retainer and the force transmitting piston. The further spring is adapted for exerting a spring load to the retainer and the force transmitting piston in such a way, that a defined position between the retainer and the force transmitting piston is adjustable. The force transmitting piston is relatively position in the engagement position with respect to the retainer by the position of rolling body. The further spring exerts the spring load to the retainer, so that the retainer rotates into a predefined position that is dependent on the position of the force transmitting piston.

According to a further exemplary embodiment, the further spring is connected between the retainer and the force transmitting piston in such a way, that, when the plate element and the retainer are disengaged, a spring load of the further spring exerts the engagement force, so that the force transmitting piston moves slideably into the engagement position. When the climbing force is transmitted by the retainer to the supporting element, the force transmitting piston is moved into the releasing position by a further spring load of the further spring.

By the described exemplary embodiment, the rolling body is freely movable inside the supporting section when the plate element and the retainer are engaged, i.e. when the climber steps onto the plate element and transmits the climbing force. When the climber steps on the plate element, the ski is pressed to the inclination of the hill. Thus, when the rolling body is freely movable when the skis are aligned to the inclination of the hill, an exact adjustment of the rolling body with respect to gravity may be provided. For this reason, a more exact adjustment of the climbing angle may be achieved because an improved alignment of the rolling body with respect to gravity is achievable.

On the other side, when the plate element and the retainer are disengaged, the further spring load of the further spring or the gravitational force of the force transmitting piston drives the force transmitting piston in the direction to the rolling body, so that the engagement position is achieved and the rolling body is clamped between the force transmitting piston and the rolling surface. Thus, an undefined movement of the rolling body when the skier lifts his feet and thereby lifts the plate element and the skis from the hill surface is preventable.

According to a further exemplary embodiment, the torsion spring and the further spring are adjusted with respect to each other in such a way, that, when the plate element and the retainer are disengaged, the torsion spring forces the retainer to rotate in a first direction (in the direction away from the plate element), so that the rotation of the retainer in the first direction affects the further spring in such a way that the spring load of the further spring exerts the engagement force to the force transmitting piston and the force transmitting piston is moved in the engagement position. Moreover, when the climbing force is exerted, the retainer is rotated by the plate element in a second direction (in the direction away to the plate element) opposed to the first direction, so that the torsion spring is pretensioned and the offset in the guide slot and/or the further spring load disengages the force transmitting piston with the rolling body, so that the rolling body is movably supported in the supporting element.

In other words, the torsion spring forces the retainer to rotate in the first direction until the further spring load of the further spring is higher or equal with respect to the torsion force of the torsion spring. The amount of the further spring load is defined by the position of the force transmitting piston with respect to the supporting element and/or with respect to the retainer. The position of the force transmitting piston with respect to the supporting element is adjustable by the gravity aligned rolling body and the inclination of the rolling surface, i.e. the position of the rolling body onto the rolling surface.

Thus, the position of the force transmitting piston with respect to the retainer defines a predefined further spring load. The predefined further spring load defines a position of the retainer, e.g. by counteracting to the torsional force of the torsion spring until a balance of forces is reached. The position of the retainer with respect to the supporting element and thus to the plate element depends on the position where the balance of forces is reached. In particular, dependent on the further spring load (that is adjusted by the gravity aligned rolling body) a defined position of the retainer is adjustable.

Hence, when the retainer is not coupled to the plate element in a released position, the adjustment of the position of the retainer with respect to the supporting element is improvable.

According to a further exemplary embodiment, the ski binding system further comprises a ski, wherein the heel elevator device is fixed to the ski.

Summarizing, a heel elevator device for a screw ski, in particular for an alpine touring ski, is provided, wherein between each step of the skier a different fixed minimum climbing angle may be provided, wherein the climbing angle is readjusted with respect to the inclination of the hill. The climbing angle may comprise values in the range between 1° to 45°, 1 to 30° degree and in a preferred embodiment 1° to 14° degree. A manual adjustment of the climbing angle is not longer necessary. Thus, time-consuming manual adjustment methods for adjusting the climbing angle respectively the angle of the plate element to the ski may be prevented due to the automatic adjustment of the climbing angle by using the claimed heel elevator device.

The heel elevator device is furthermore adapted to be integrated in all common alpine touring bindings and to all common alpine touring skis. The heel elevator device may in particular be integrated or fixed to alpine touring bindings from the companies Dynafit, Diamir or Fritschi.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

BRIEF DESCRIPTION OF THE DRAWINGS

The invention will be described in more detail hereinafter with reference to examples of embodiments but to which the invention is not limited.

DESCRIPTION OF EMBODIMENTS

Figure 1:
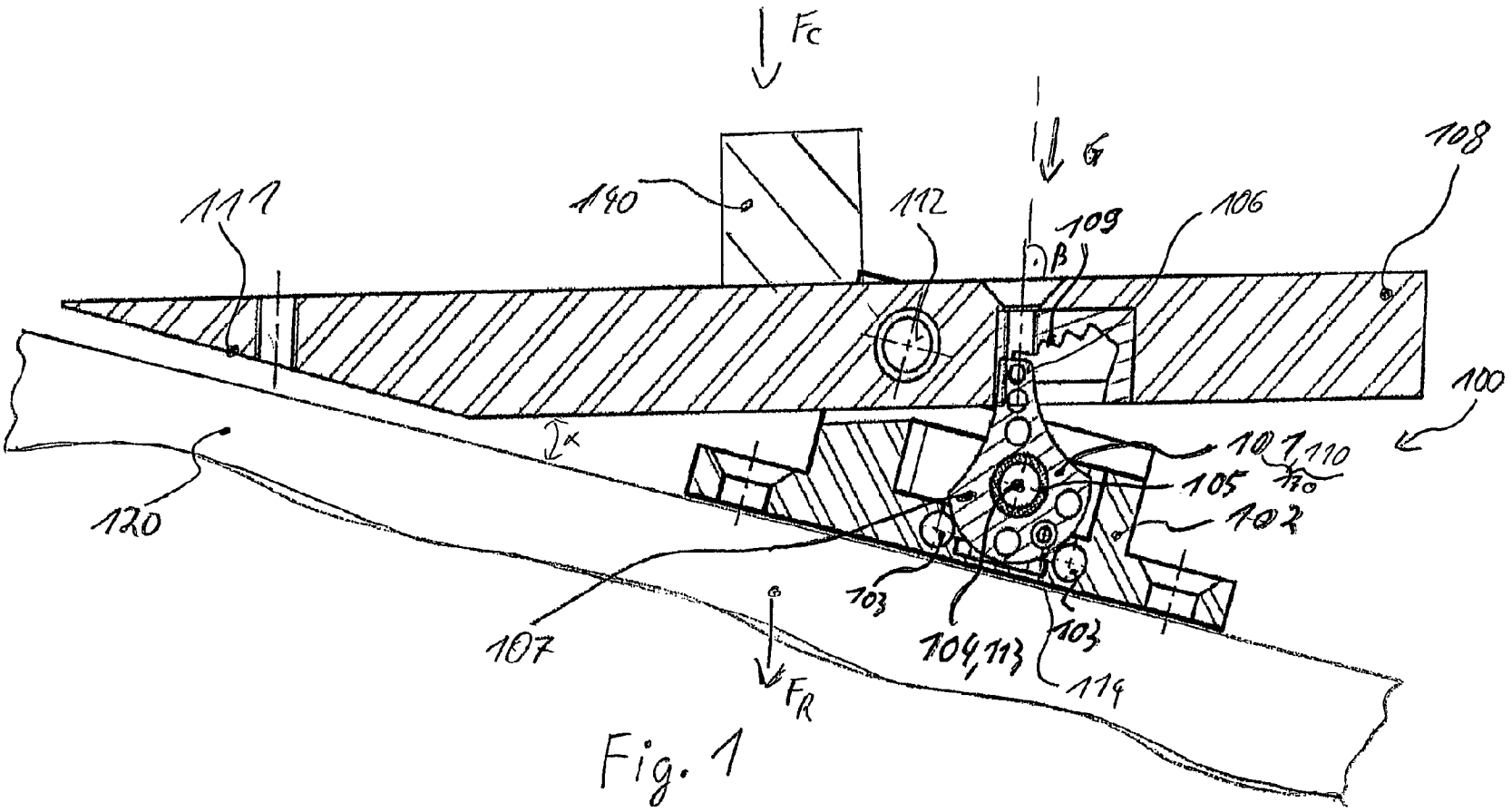
FIG. 1 shows a schematic sectional view of an exemplary embodiment of the heel elevator device.

The illustrations in the drawings are schematically. In different drawings similar or identical elements are provided with the same reference signs.

FIG. 1 shows a heel elevator device 100 for a ski 120, wherein the heel elevator device 100 is adapted for being fixed to the ski 120 and adapted for connecting a plate element 108 to the ski 120. The plate element 108 comprises a ski binding or a sole of a ski boot. The heel elevator device 100 comprises a supporting element 102 with a supporting section 801, a gravity based positioning element 130 movably supported in the supporting element 102 and a force transmitting piston 805 with a piston engaging section 806. The force transmitting piston 805 is slideably attached to the supporting section 801 in such a way that, when an engagement force is exerted, the force transmitting piston 805 moves slideably into an engagement position. In the engagement position, the piston engaging section 806 is engaged with the gravity based positioning element 130 for fixing the gravity based position element 130, wherein, when the gravity based positioning element 130 is fixed, the gravity based positioning element 130 is adapted for adjusting a fixed minimum climbing angle α of the plate element 108 with respect to the ski 120. When the gravity based positioning element 130 is movably supported in the supporting element 102, the gravity based positioning element 130 is adapted for being aligned to gravity.

In particular, FIG. 1 shows pendulum element 101 (as an example for a gravity based positioning element 130) rotatably fixed to the supporting element 102. When the plate element 108 and the ski 120 are rigidly coupled, the pendulum element 101 is torque proof fixed to the supporting element 102 and the pendulum element 101 is furthermore adapted for fixing the plate element 108 in a fixed minimum climbing angle α with respect to the ski 120. When the ski binding and the ski 120 are decoupled, the pendulum element 101 is pivotably fixed to the supporting element 102, so that the pendulum element 101 is adapted for being aligned to gravity.

The fixed minimum climbing angle α defines an angle between the plate element 108 to the ski 120. When ascending a hill with the heel elevator device 100, the heel elevator device 100 ensures that a movement of the heel of a ski boot in the direction to the ski is limited. This limited position, for instance a horizontal position of the plate element 108, may be defined by the fixed minimum climbing angle α measured between the plate element 108 with respect to the ski 120. With other words, the fixed minimum climbing angle α defines the smallest allowable angle between the plate element 108 with respect to the ski 120.

In FIG. 1, the ski binding 140 is mounted to the plate element 108. The plate element 108 is pivotably fixed to the supporting element 102 and provides a rotary axis 112.

When a skier conducts a step up the mountain, a climbing force Fc is transmitted to the ski binding 140 and/or the plate element 108. In this status, when transmitting the climbing force Fc, the climbing angle α prevents a further backward movement of the plate element 108 to the ski is possible, i.e. defines the minimum angle between the plate element 108 and the ski 120. If the plate element 108 is kept e.g. in a horizontal position, the skier moves up the hill like stepping up a stairway, which is more ergonomically in comparison to a plate element 108 that may move backward parallel to the ski 120 that is parallel to the inclination of a hill.

By the heel elevator device 100 the fixed minimum climbing angle α may be adjusted to a variation of the different inclinations of the hill between each step of the skier. Thus, for a variation of different inclinations of the hill, the ski binding 140 and/or the plate element 108 may be kept in a constant (horizontal) position.

The automatic adjustment of the fixed minimum climbing angle α is provided by the pendulum element 101. When the skier lifts his ski boot and thus the ski binding 140 and/or the plate element 108, a load releasing force Fr in opposite direction to the climbing force Fc is transmitted. The load releasing force Fr may be for instance the weight of the ski that exerts in an opposite direction to the lifting motion of a ski boot. In this status, the pendulum element 101 is pivotable with respect to the supporting element 102 that is rigidly fixed to the ski 120. Thus, the pendulum element 101 may rotate such that the pendulum element 101 is aligned to gravity, in particular to the direction of the gravity G. Thus, when exerting again the weight of the skier to the plate element 108 and when transmitting again the climbing force Fc, the pendulum element 101 engages the ski binding or the plate element 108 and is fixed torque proof again to the supporting element 102 by the fixing device 103. Thus, when the supporting element 102 is rigidly fixed to the ski 120, the fixed minimum climbing angle α is provided. I.e. if the fixed minimum climbing angle α is fixed, a relative movement between the plate element 108 and the ski 120 in a backward movement of the heel is prevented.

The ski 120 lies in general parallel to the surface of the hill. Thus, if the inclination of the hill is changed, the fixed minimum climbing angle α between the plate element 108 and the ski 120 has to be changed as well in order to keep the position of the ski binding 140 and the plate element 108 in an ergonomic position, e.g. in a horizontal position.

FIG. 1 furthermore illustrates the fixation device 103 that may comprise two bolts to which the pendulum element 101 may be in contact to. When the climbing force Fc is exerted to the plate element 108 in the direction to the ski 120, the pendulum element 101 may be pressed against the fixation device 103, respectively the bolts, so that the pendulum element 101 is in frictional contact with the fixation device 103. Thus, any rotational movement of the pendulum element 101 may be prevented. When the pendulum element 101 is torque proof fixed also the fixed minimum climbing angle α is fixed.

The bolts of the fixing device may be elastically for providing a damping effect.

When the load releasing force Fr is exerted to the plate element 108 in opposite direction to the ski 120 the pendulum element 101 may move away from the fixation device 103 and is thus pivotable again. When the pendulum element 101 is pivotable, the pendulum element 101 aligns itself to the direction of gravity G. Thus, if the position of the ski 120 or the inclination of the hill is changed, the position of the pendulum element 101 with respect to the ski 120 is changed as well. Independent from the changed inclination of the hill, the pendulum element engages a receiving section 109 in such a way that a rigid angle β between the ski binding 140 or the plate element 108 with respect to the pendulum element comprises is kept constant. Thus, even if the inclination of the hill, the ski 120 or the supporting element 102 changes its position and thus the fixed minimum climbing angle α is changed, the rigid angle β between the pendulum element 101 and the ski binding 140 or the plate element 108 is kept constant.

FIG. 1 shows an exemplary embodiment of the heel elevator device 100, wherein the extending direction of the pendulum element 101 is perpendicular to the plane of the ski binding 140 or the plate element 108. If the ski inclination 120 is getting flatter, i.e. in a more horizontal plane, the pendulum element 101 pivots due to gravity in a clockwise direction when the load releasing force Fr is exerted. When the pendulum element 101 is aligned to the direction of gravity G again and the climbing force Fc is exerted, the engagement section 106 of the pendulum device 101 engages the receiving section 109 of the ski binding 140 or the plate element 108, e.g., according to the present example, in a slot that is located more to the right side of the receiving section 109 and more inside of the receiving section 109. Thus, the fixed minimum climbing angle α is smaller for the flatter inclination in comparison to the steeper inclination before. On the other side, the rigid angle β between the pendulum element 101 and the plate element 108 or the plate element 108 is kept constant, such as 90° degree.

This shows that for a change of inclination, the fixed minimum climbing angle α may be adapted and aligned by the heel elevator device 100, whereas the orientation and alignment of the ski binding 140 and the ski plate element 108 with respect to the pendulum element 101 may kept constant by the rigid angle β.

Furthermore, FIG. 1 illustrates a floating pin 104, for pivotably supporting the pendulum element 101 to the supporting element 102. The floating pin 104 may floatably fix the pendulum element 101 to the supporting element 102. Thus, when the climbing force Fc is exerted, the floating pin 104 may move to the direction of the fixation device 103 for fixing the pendulum element 101 torque proof.

When the load releasing force Fr is exerted to the ski 120, the floating pin 104 is adapted for moving the pendulum element 101 away from the fixing device 103, so that the pendulum element 101 is pivotable and adjustable again. The floating pin 104 may comprise an elastic pin that may be movable due to the climbing force Fc and/or the load releasing force Fr.

Furthermore, an elastic bearing ring 105 may be provided. The elastic bearing ring 105 may be mounted to the floating pin 104 and holding the pendulum element 101 floatably to the floating pin 104. Thus, the floating pin 104 may be designed rigidly and may not be movable with respect to the supporting element 102. Thus, the elastic bearing ring 105 may be squeezed when the climbing force Fc is exerted, so that the pendulum element 101 is moved in the direction to the fixation device 103. When the load releasing force Fr is exerted, the elastic bearing ring 105 may be expanded, so that the pendulum element 101 may be moved away from the fixation device 103 and is thus pivotable again.

Furthermore, the pendulum element 101 may be divided into an alignment pendulum 310 and a support pendulum 110. An exemplary embodiment of the support pendulum 110 is illustrated in FIG. 1, wherein an exemplary embodiment of the alignment pendulum 310 is provided in FIG. 3. The alignment pendulum 310 and the support pendulum 110 are coupled, so that the rotary movement of the alignment pendulum 310 is similar to the support pendulum 310 and vice versa. The alignment pendulum 310 and the support pendulum 110 may be located to the same axis and provide the same rotary axis. Furthermore, the alignment pendulum 310 and the supporting pendulum 110 may be coupled magnetically for instance by adding first magnetic elements 114 to the supporting pendulum 110 and second magnetic elements 309 to the alignment pendulum 310. Thus, no mechanical coupling mechanisms may be provided. Furthermore, the first rotary axis 305 of the alignment pendulum 310 and the second rotary axis 113 of the supporting pendulum 110 may be located on different pins or axes that may also be spaced.

Furthermore, FIG. 1 illustrates the supporting pendulum 110 that is rotatably fixed to the supporting element 102. The supporting pendulum 110 may provide an engagement section 106 and a second fixation section 107. In the region of the second fixation region 107, the supporting pendulum 110 may be rotatably fixed to the supporting element 102. With other words, the supporting pendulum 110 provides a function to transmit the climbing force Fc from the plate element 108 to the supporting element 102 and to the ski 120.

The engagement section 106 is adapted for engaging with a receiving section 109 of the plate element 108 or directly to the receiving section of the plate element 108. The engagement section 106 may be designed as a flange. The receiving section 109 may be designed with defined slots or grooves that may receive the flange of the engagement section 106 in such a way that the rigid angle β is kept constant also for a variety of different engaging positions of the engagement section 106 of the supporting pendulum 110.

Figure 2:
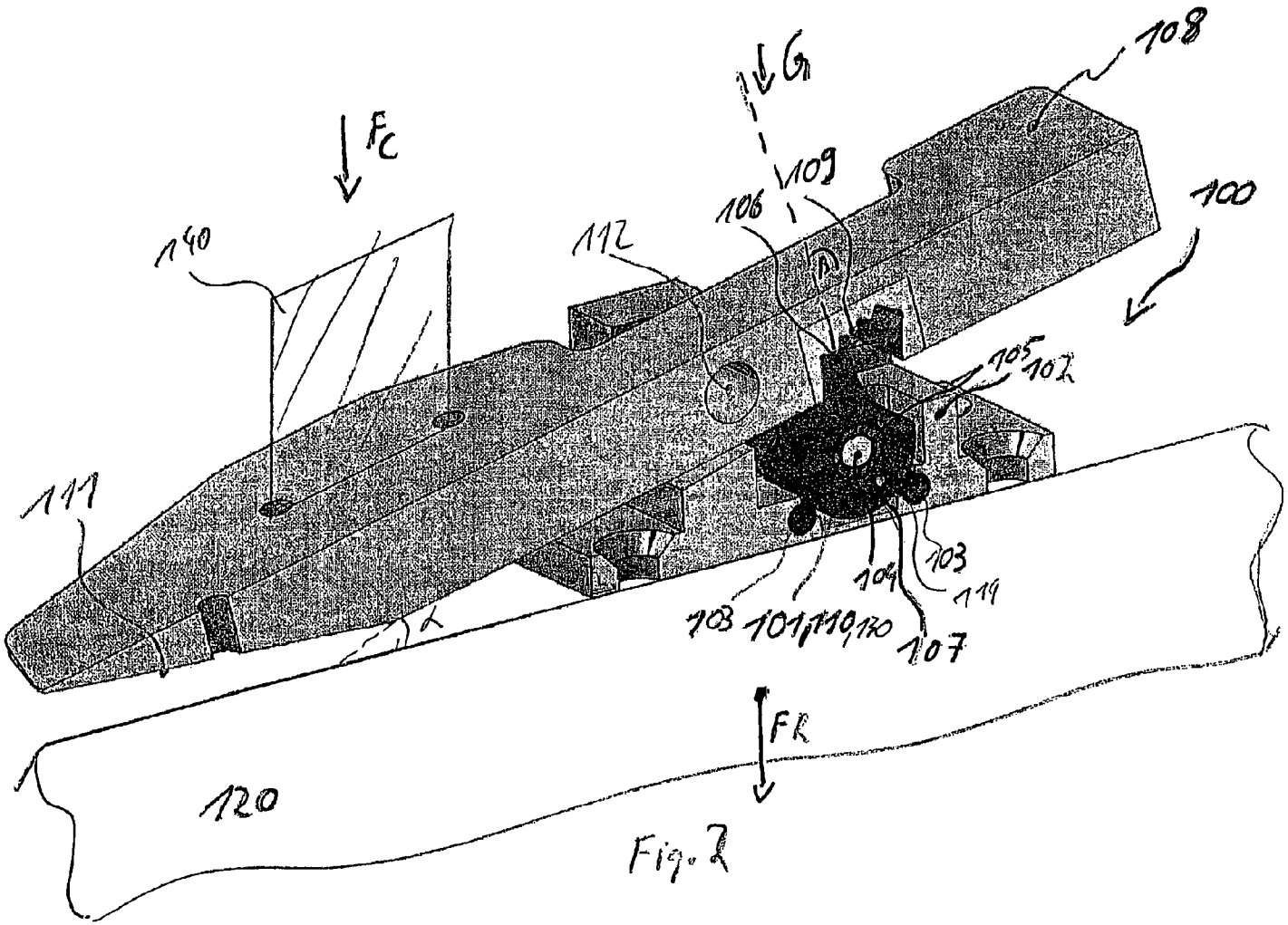
FIG. 2 shows a sectional view of a perspective view of the exemplary embodiment shown in FIG. 1.

FIG. 2 illustrates a perspective view of the exemplary embodiment of FIG. 1.

Figure 3:
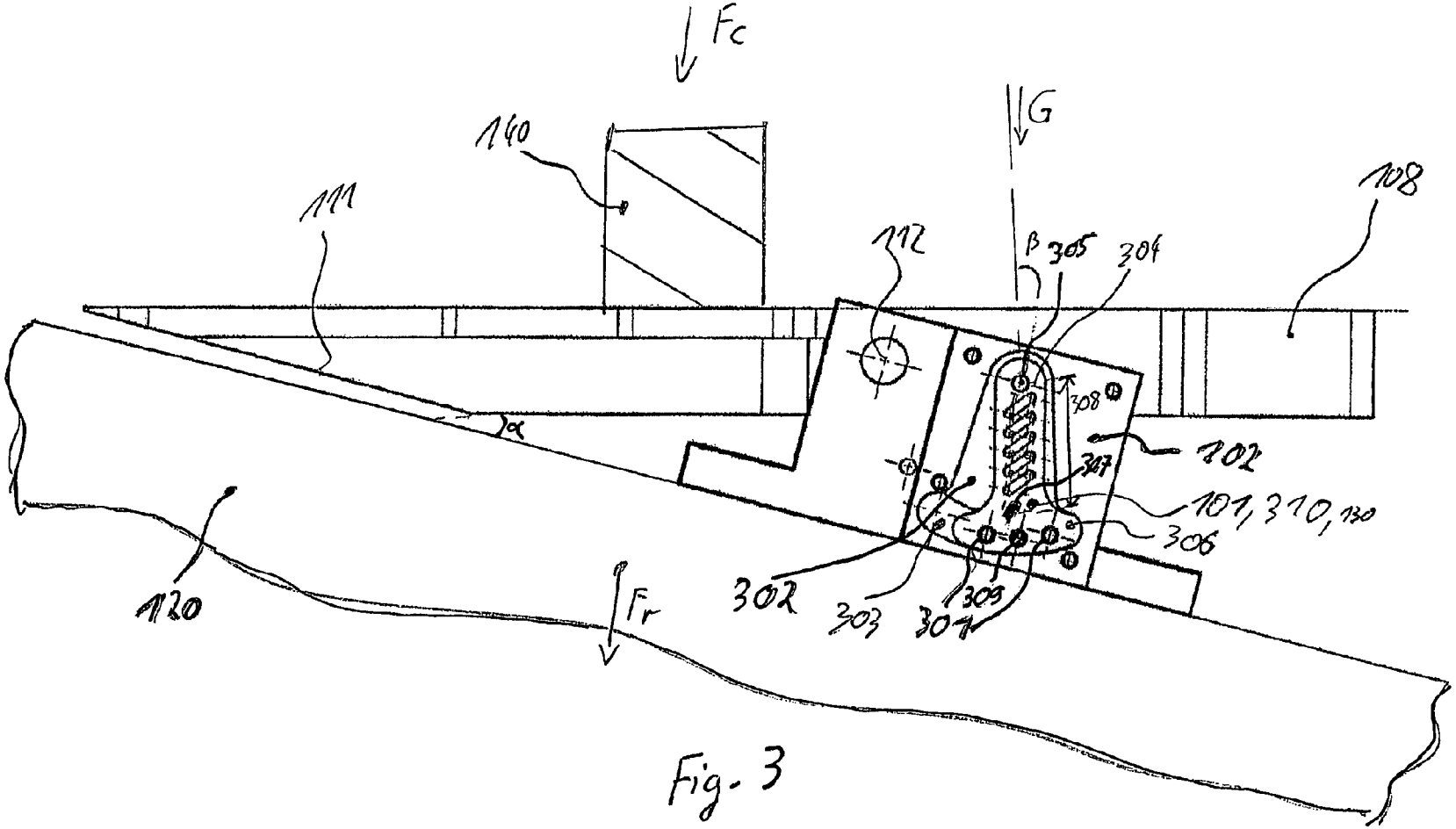
FIG. 3 shows a schematic illustration of an exemplary embodiment of the present invention.

FIG. 3 illustrates a schematic view of the alignment pendulum 310. The alignment pendulum 310 is adapted for being aligned to gravity. Therefore, the alignment pendulum 310 comprises a first fixation section 304 and a weight section 306. The first fixation section 304 comprises a first rotary axis 305 of the alignment pendulum 310, with which the alignment pendulum 310 is rotatably connected to the supporting element 102. A center of gravity of the alignment pendulum 310 is located in the weight section 306, wherein the weight section 306 is spaced from the first rotary axis 305 for providing a lever arm 308. Thus, if the load releasing force Fr is exerted, the alignment pendulum 310 is pivotable around the first rotary axis 305, so that the alignment pendulum is adapted for being aligned to the direction of gravity G. Thus, if the alignment pendulum 310 rotates, the supporting pendulum 110 rotates similar to the alignment pendulum 310. Thus, when the alignment pendulum 310 is aligned to gravity, also the supporting pendulum 110 is aligned to gravity.

For increasing the rotary moment of the aligning pendulum, the lever arm 308 may be enlarged. Therefore, weight elements 301 may be located to the weight section 306, so that the center of gravity 307 of the alignment pendulum 310 is located away from the first rotary axis 305.

Due to the separation of the functions of the supporting pendulum 110 and the alignment pendulum 310 the design of the pendulums 110, 310 may be specified. I.e. the weight of the alignment pendulum 310 may be reduced because the alignment pendulum 310 may not need to transmit the climbing force Fc. In order to improve the alignment function of the alignment pendulum 310 an enlarged lever arm 308 may only be necessary. On the other side, the supporting pendulum 110 may be designed strong for transmitting the climbing force Fc.

Furthermore, FIG. 3 illustrates a vibration absorber device 302. The vibration absorber device 302 is adapted for absorbing a vibration and oscillation of the pendulum element 101 when aligning to gravity. The vibration absorber device 302 may comprise an isolated chamber 303 wherein the isolated chamber 303 isolates at least a part of the pendulum element 101 or that is adapted for surrounding the complete alignment pendulum 310. The isolated chamber 303 may comprise a fluid through which the pendulum element 101, 310 may be moved. The fluid in the isolated chamber provides a counterforce in an opposite direction to the movement of the pendulum element 101, 310. Thus, the movement of the pendulum element 101, 310 may be slowed down so that vibrations or oscillations may be reduced and the pendulum element 101, 310 may be aligned to gravity G in a shorter time. In case the alignment pendulum 310 is coupled to the supporting pendulum 110 magnetically, i.e. without any mechanical connection systems, the isolated chamber 303 may completely surround the alignment pendulum 310.

The alignment pendulum 310 and the support pendulum 110 may also be decoupled by a decoupling device, so that a readjustment between the positions of the alignment pendulum 310 and the supporting pendulum 110 may be provided. Thus, an individual rigid angle β may be manually predetermined, for instance.

Figure 4:
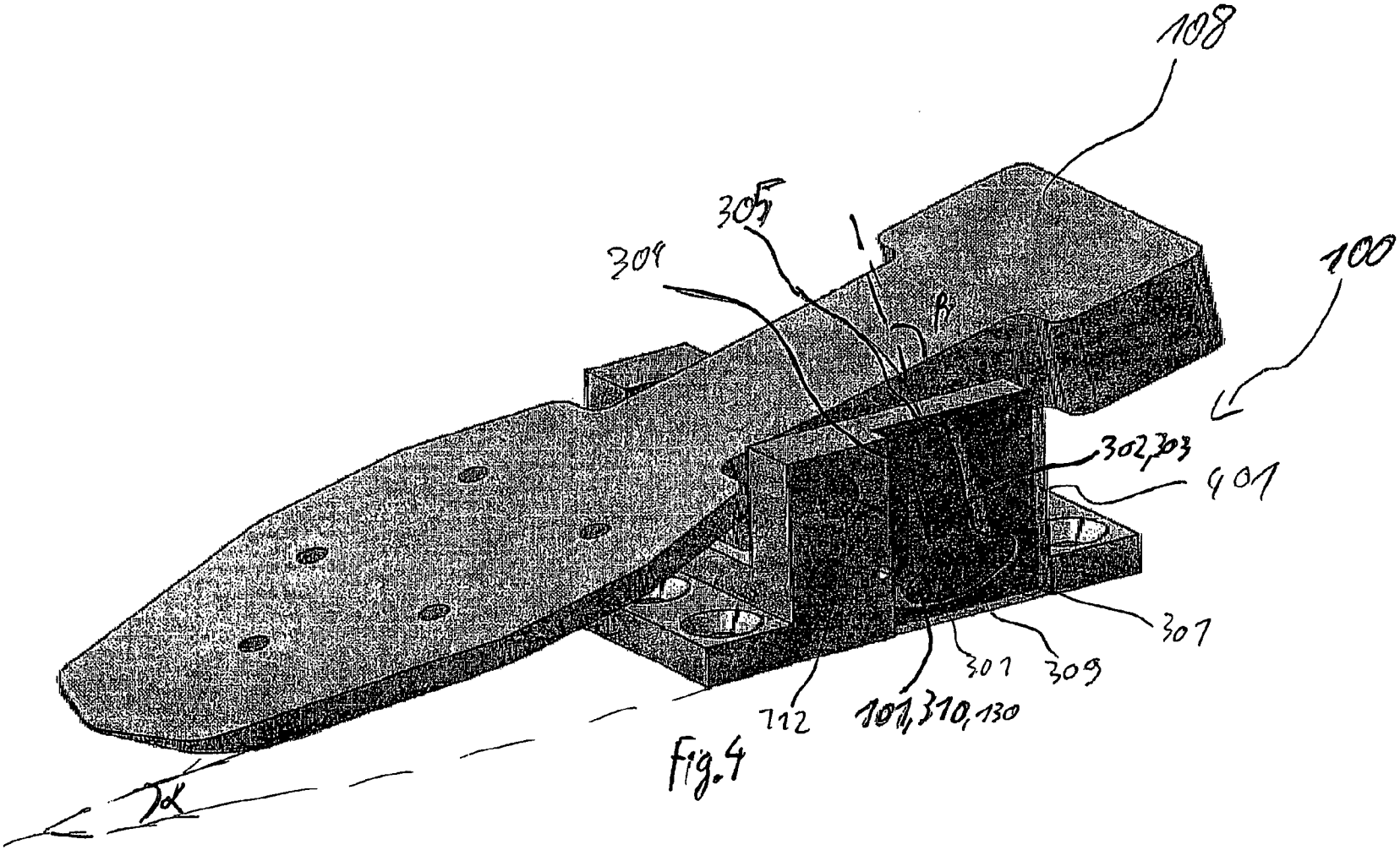
FIG. 4 shows a schematic illustration of a perspective view of the exemplary embodiment shown in FIG. 3.

FIG. 4 illustrates a perspective view of the exemplary embodiment of FIG. 3.

Figure 5:
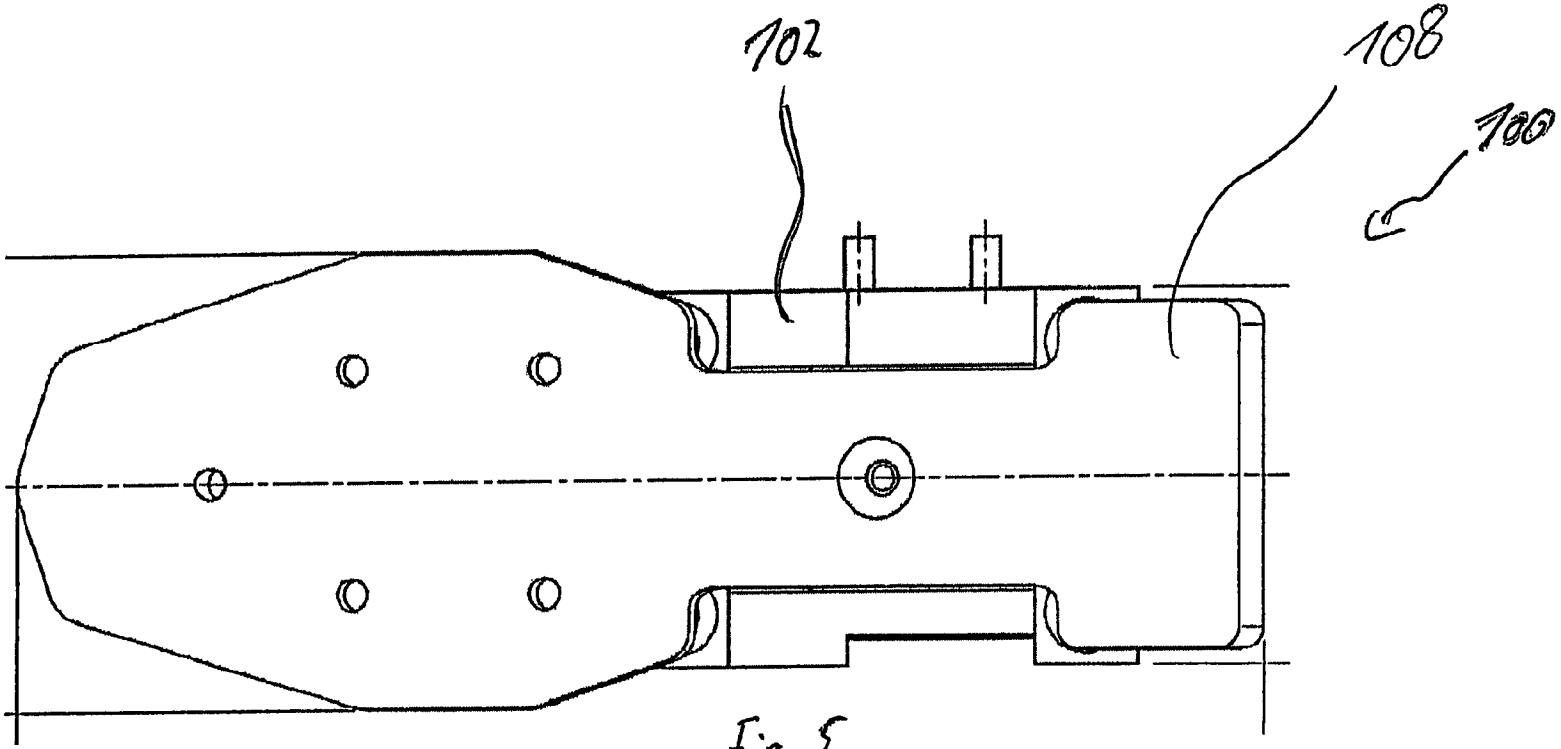
FIG. 5 shows a top view on a plate element according to an exemplary embodiment of the invention.

FIG. 5 illustrates a top view of the exemplary embodiments of FIG. 1 and FIG. 3, wherein the plate element 108 is shown that is mounted to the supporting element 102. Thus, the plate element 108 may be ergonomically designed, so that the shape of plate element 108 may correspond to the shape of a ski boot in order to improve the force transmitting, in particular of the climbing force Fc.

Figure 6:
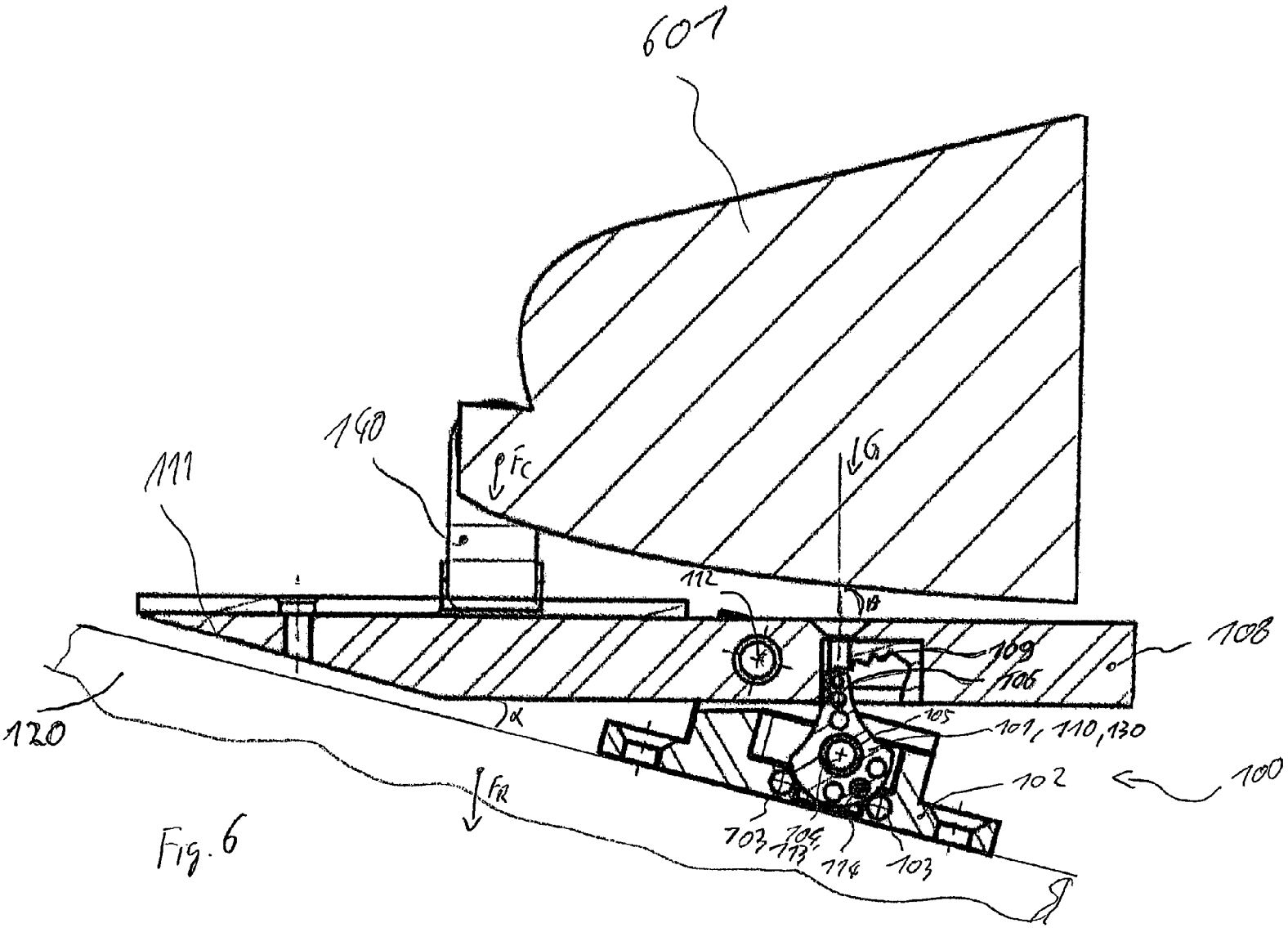
FIG. 6 shows a sectional view of an exemplary embodiment of the present invention including a ski boot fixed to a plate element.

FIG. 6 illustrates an exemplary embodiment of FIG. 1. Furthermore, FIG. 6 illustrates a ski boot connected to the plate element 108. During climbing up the hill, the climbing force Fc is exerted and transmitted by the plate element 108 to the pendulum element 101, 110. The pendulum element is adapted for keeping the fixed minimum climbing angle α constant during transmission of the climbing force Fc. Thus, a stable horizontal plate element 108 may be provided, so that the skier may step ergonomically up the hill. In FIG. 6, the fixed minimum climbing angle is illustrated with its maximum value, because the pendulum element 101, 110 is located with its engagement section 106 on the outer most left side in the receiving section 109. If the inclination of the ski 120 and respectively the hill is getting flatter, the fixed minimum climbing angle α may be reduced for providing a horizontal alignment of the plate element 108 and the ski binding 140. Thus, the pendulum element 101, 110 is aligned to gravity G when the load releasing force Fr is exerted and rotates, when inclination is getting flatter, around the second rotary axis 113. Thus, when the climbing force Fc is exerted again, the engagement section 106 is engaged to another position in the receiving section 109, as before. In the present example shown in FIG. 6, the engagement section 106 would engage the receiving section 109 at a more left position. Thus, the plate element 108 is horizontal even if the inclination of the ski 120 and the fixed minimum angle α is changed between the steps. Thus, an automatic adjustment may be provided.

Figure 7:
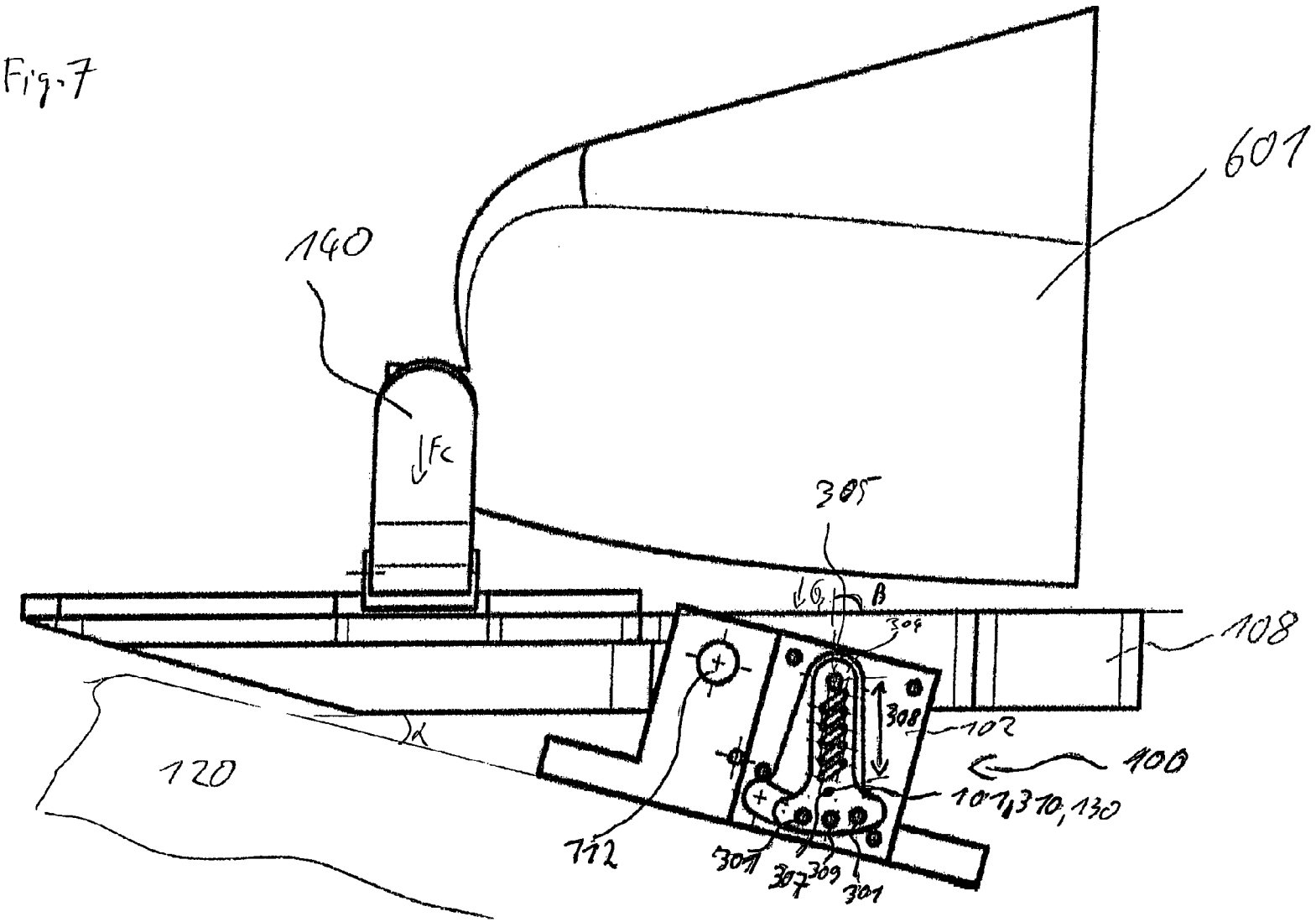
FIG. 7 shows a further exemplary embodiment of the present invention with a ski boot fixed to the heel elevator device.

FIG. 7 illustrates an exemplary embodiment as shown in FIG. 3, wherein the alignment pendulum 310 is shown. Between the steps when the load releasing force Fr is acting, the alignment pendulum 310 is aligned to gravity G, so that an adjustment of the fixed minimum climbing angle α due to the inclination of the ski may be provided.

Figure 8:
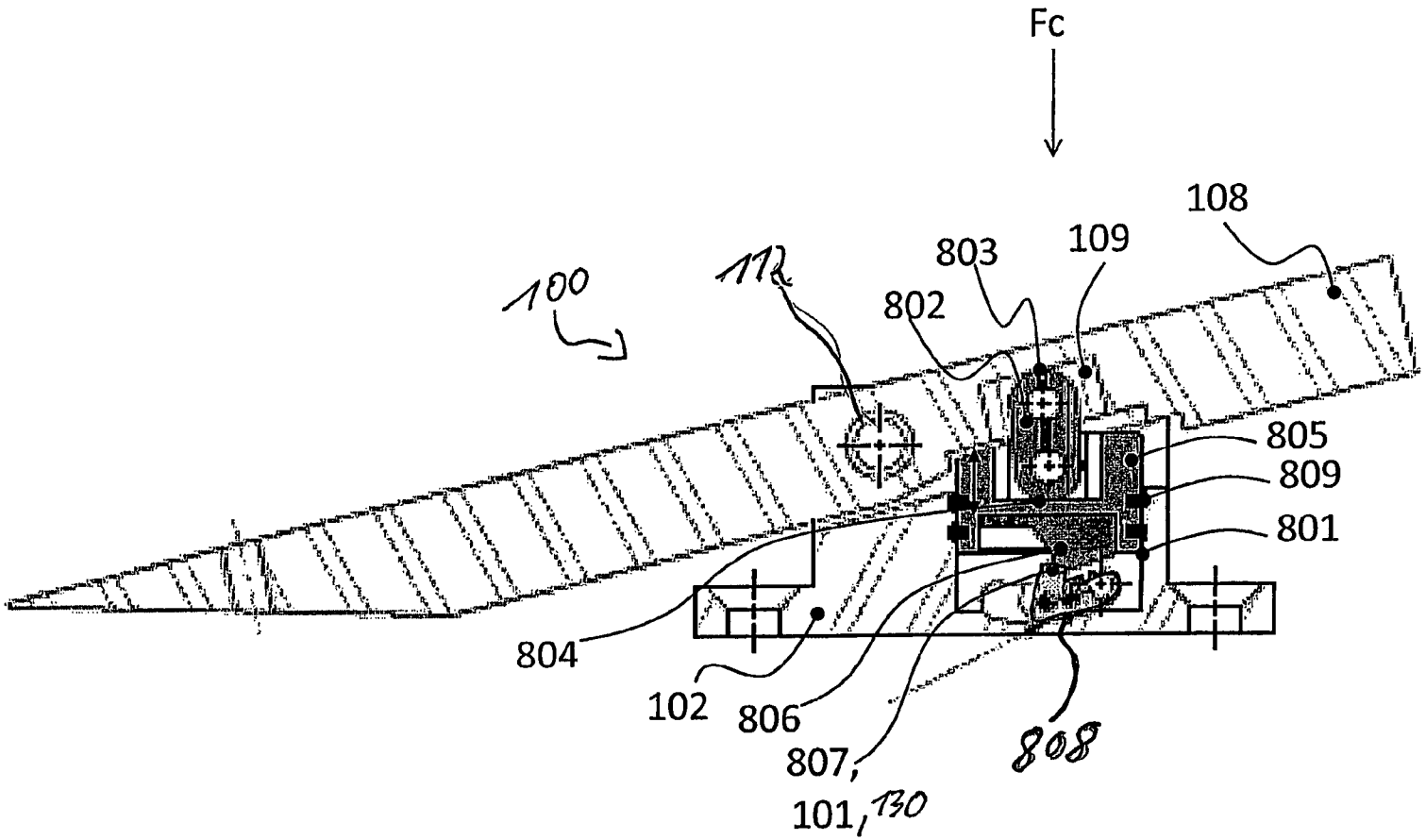
FIG. 8 shows a schematical view of the heel elevator device comprising a force transmitting piston and a connection rod according to an exemplary embodiment of the present invention.

FIG. 8 illustrates a detailed view of a further exemplary embodiment of the invention. FIG. 8 shows the heel elevator device 100 for the ski 120, wherein the heel elevator device 100 is adapted for being fixed to the ski 120 and adapted for connecting the plate element 108 to the ski 120, wherein the plate element 108 comprises the ski binding or the sole of a ski boot. The heel elevator device 100 comprises the supporting element 102 with the supporting section 801, the gravity based positioning element 130 (e.g. the pendulum element or the rolling body 1401 (see FIG. 14)) movably supported in the supporting element 102, and a force transrr force is exerted, the force transmitting piston 805 moves slideably into an engagement position. In the engagement position, the piston engaging section 806 is engaged with the gravity based positioning element 130 for fixing the gravity based positioning element 130. When the gravity based positioning element 130 is fixed, the gravity based positioning element 130 is adapted for fixing the plate element 108 in a fixed minimum climbing angle α with respect to the ski 120, and, when the gravity based positioning element 130 is movably supported in the supporting element 102, the gravity based positioning element 130 is adapted for being aligned to gravity.

The shown heel elevator device 100 shows furthermore a connection rod 802 with a first force transmission section 803 and a second force transmission section 804. The connection rod 802 is rotatably fixed to the receiving section 109 and to the supporting section 801 of the supporting element 102. The connection rod 802 may be coupled to the receiving section 109 directly or indirectly by the strut element 1101 (see e.g. FIG. 11). The first force transmission section 803 is adapted for receiving the climbing force Fc by a force closure from the receiving section 109 directly or indirectly. The second force transmission section 804 is adapted for transferring the climbing force Fc by a force closure to the supporting section 801.

The force transmitting piston 805 is slideably attached to the supporting section 801. When the climbing force Fc is exerted, the force transmitting piston 805 moves slideably into an engagement position, wherein, in the engagement position, the piston engaging section 806 is engaged with the gravity based positioning element 130 for fixing the gravity based positioning element 130. When the plate element 108 and the ski 120 are rigidly coupled, the gravity based positioning element 130 is fixed to the supporting element 102 and the gravity based positioning element 130 is adapted for fixing the plate element 108 in a fixed minimum climbing angle α with respect to the ski 120. When the plate element 108 and the ski 120 are decoupled (i.e. in an disengagement position of the engaging section 806 with the gravity based positioning element 130), the gravity based positioning element 130 is movably fixed to the supporting element 102, so that the gravity based positioning element 130 is adapted for being aligned to gravity.

The plate element 108 is connected to the connection rod 802. The plate element 108 comprises the receiving section 109, wherein the supporting element 102 comprises the supporting section 801. The connection rod 802 is rotatably fixed to the receiving section 109 and to the supporting section 801 for being coupled to the supporting element 102. The first force transmission section 803 is adapted for receiving the climbing force Fc by a force closure from the receiving section 109. The second force transmission section 804 is adapted for transferring the climbing force Fc by a force closure to the supporting section 801.

When providing the connection rod 802, the climbing force Fc or at least a part of the climbing force Fc may be transferred from the plate element 108 to the supporting element 102 by the connection rod 802 instead of transferring the whole climbing force Fc by the pendulum element 101. Thus, the pendulum element 101 may be constructed with a less weight.

Moreover, the connection rod 802 may be supported rotatably to the receiving section 109 and to the supporting section 801 by rotary pins. The connection rod 802 furthermore comprises the first transmission sections 805 and second transmission sections 806 by which the climbing force Fc may be transferred. The first transmission section 805 and second transmission section 806 may form a first surface and a second surface of the connecting rod 802, which may form a physical contact (form closure contact, form fit contact, force closure contact) to the receiving section 109 and/or the supporting section 801. Thereby, the climbing force Fc may be transferred by the physical contact of the first surface and second surface and not by the rotary pins. Thus, the rotary pins may be constructed with a less weight, because the rotary pins may only be used for rotatably supporting the connection rod 802 and not for transferring the climbing force Fc.

Furthermore, FIG. 8 shows a force transmitting piston 805 comprising a piston engaging section 806. The force transmitting piston 805 is slidably attached to the supporting section 801, as indicated by the arrows in FIG. 8. The pendulum element 101 comprises an engagement element 807, wherein, when the climbing force Fc is exerted, the force transmitting piston 805 moves slidably into an engagement position. In the exemplary embodiment shown in FIG. 8 the engagement position is achieved when the engagement element 807 is in contact with the piston engaging section 806. In the engagement position, the piston engaging section 806 is engaged by the engagement element 807 of the pendulum element 101, so that the pendulum element 101 is torque proof fixed.

The engagement element 807 may form in an exemplary embodiment a part of the alignment pendulum 310 and/or a part of the supporting pendulum 110.

The force transmitting piston 805 may be slidably in the direction of the climbing force Fc and in the direction of the load releasing force Fr, so that the force transmitting piston 805 may move along a first direction, when the climbing force Fc acts, and so that the transmitting piston 805 may move along a second direction, when the load releasing force Fr acts. I.e. when the force transmitting piston 805 receives the climbing force Fc e.g. from the second force transmission section 804 of the connection rod 802, the force transmitting piston 805 moves along the first direction into the engagement position and thereby engage with its piston engagement section 806 the engagement element 807 of the pendulum element 101, so that the pendulum element 101 is rotatably fixed. When the load releasing force Fr acts to the force transmitting piston 805, the force transmitting piston 805 moves along the second direction and thereby release with its piston engaging section 806 the engagement element 807 of the pendulum element, so that the pendulum element is rotatably again.

The piston engagement section 806 may be formed with a recess into which a coign or a step shaped surface of the engagement element 807 may be engaged, as shown in FIG. 8. The engagement section 806 may also be formed with a coign or a step shaped surface into which a recess of the engagement element 807 may be engaged.

As sown in FIG. 8, the pendulum element 101 is rotatably fixed to the supporting element 102 in such a way that, when climbing force Fc is exerted, the engagement element 807 is in frictional contact with the supporting element 102, and, when the load releasing force Fr is exerted, a gap 808 between the engagement element 807 and the supporting element 102 is provided.

The pendulum element 101 may be supported floatably (springy or elastically), e.g. by the floating pin 104, so that when the climbing force Fc acts, the pendulum element 101 moves in the direction of the supporting element 102 and thereby generates a physical contact to the supporting element 102 for transmitting the climbing force Fc. In other words, the climbing force Fc or a part of the climbing force Fc is transmitted by the physical contact and not by the supporting pin 104 or the floating pin of the pendulum element 101. Thus, the supporting pin and/or the floating pin 104 may be formed more lightweight because fewer loads will act on the supporting pin and/or the floating pin 104. Moreover, a further prevention from an undesired rotation of the pendulum element 101 may be achieved due to the additional frictional contact of the pendulum element 101 with the supporting element 102. When load releasing force Fr acts, the pendulum element 101 may move away from the supporting element 102, so that the gap 808 (e.g. 0.2 to 0.3 mm (Millimeter)) may provided and no frictional contact is provided. Thus, the pendulum element 101 may be rotatable again.

FIG. 8 furthermore illustrates the sealing ring 809. When the force transmitting piston 805 is formed for instance circular or elliptical the sealing ring 809 may be attached, so that the sealing ring 809 may prevent an entering of dust particles in the inside of the heel elevator device 100.

The force transmitting piston 805 shown in the exemplary embodiment in FIG. 8 may also be installed in the exemplary embodiments shown in FIG. 1 to FIG. 7. For example, the force transmitting piston 805 may also be installed inside the isolated chamber 303.

Figure 9:
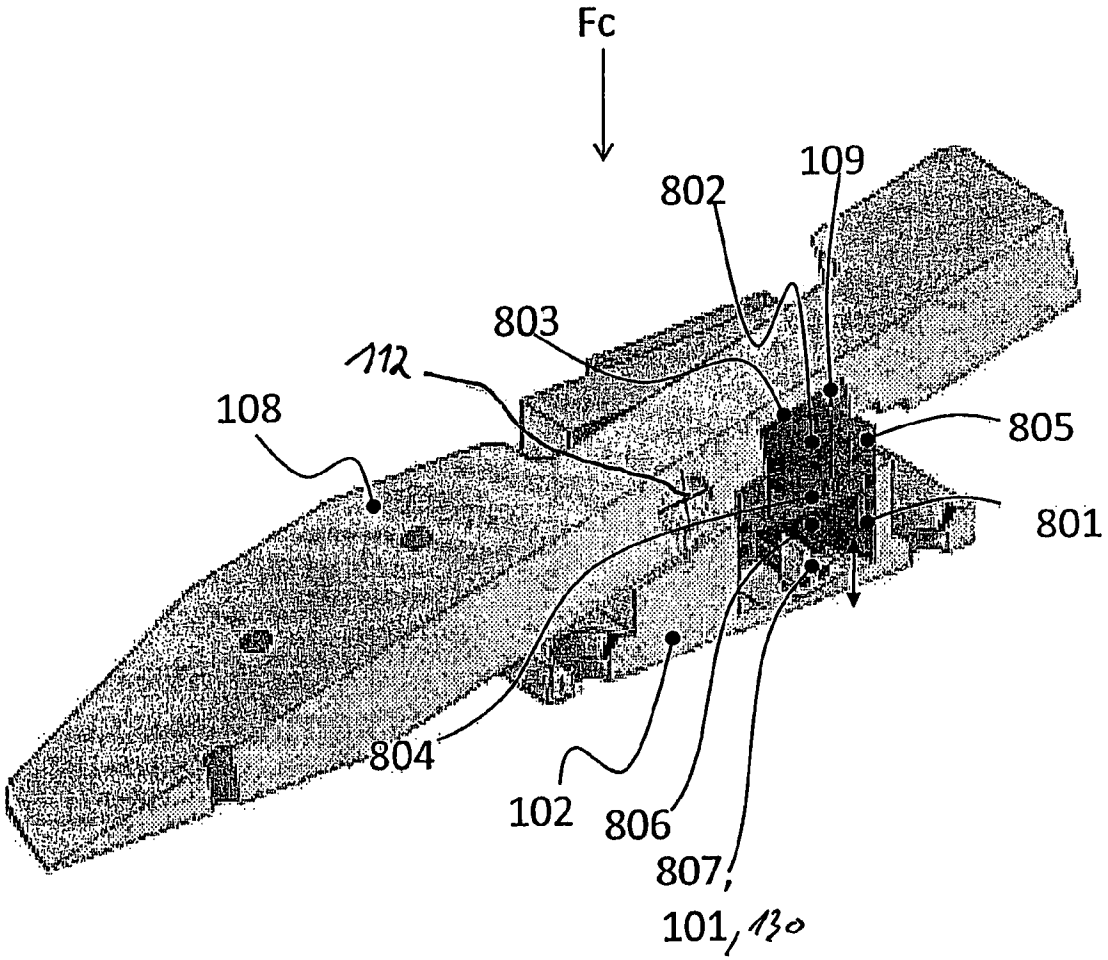
FIG. 9 shows a perspective view of the exemplary embodiment shown in FIG. 8.

FIG. 9 illustrates a perspective view of the exemplary embodiment of the heel elevator device comprising the force transmitting piston 805 shown in FIG. 8.

Figure 10:
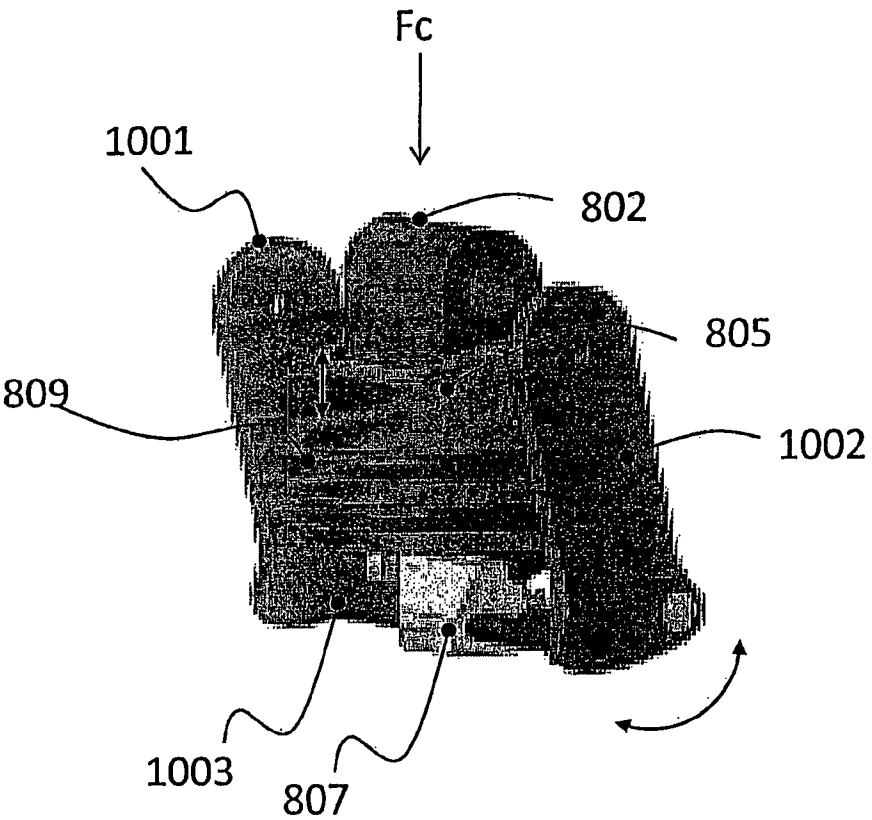
FIG. 10 shows a schematical view of the force transmitting piston.

FIG. 10 illustrates an enlarged view of the force transmitting piston 805. Moreover as shown in FIG. 10, the pendulum element 101 may comprise a first pendulum part 1001, a second pendulum part 1002 and a pendulum rod 1003. The first pendulum part 1001 and the second pendulum part 1002 are rotatably fixed to the supporting element 102. The first pendulum part 1001 and the second pendulum part 1002 are connected by the pendulum rod 1003, so that a rotary motion of the pendulum parts 1001, 1002 is synchronized. The engagement element 807 may be fixed to the pendulum rod 1003. As shown in FIG. 10 also two or more pendulum rods 1003 may be provided.

The first pendulum part 1001 and the second pendulum part 1002 may be rotatably fixed to the supporting element 102, wherein the pendulum rod 1003 connects both pendulum parts 1001, 1002 and provides the same rotation movement. Thus, each pendulum part 1001, 1002 may be connected to outer surfaces of the supporting element 102, wherein the pendulum rod 1003 extends through the center of the supporting element 102 for connecting both pendulum parts 1001, 1002. In the center of the supporting element, the pendulum rod 1003 may comprise the engagement element 807, so that the engagement element 807 may be placed inside the supporting element 102, wherein the pendulum parts 1002, 1003 may be connected outside of the supporting element 102.

Figure 11:
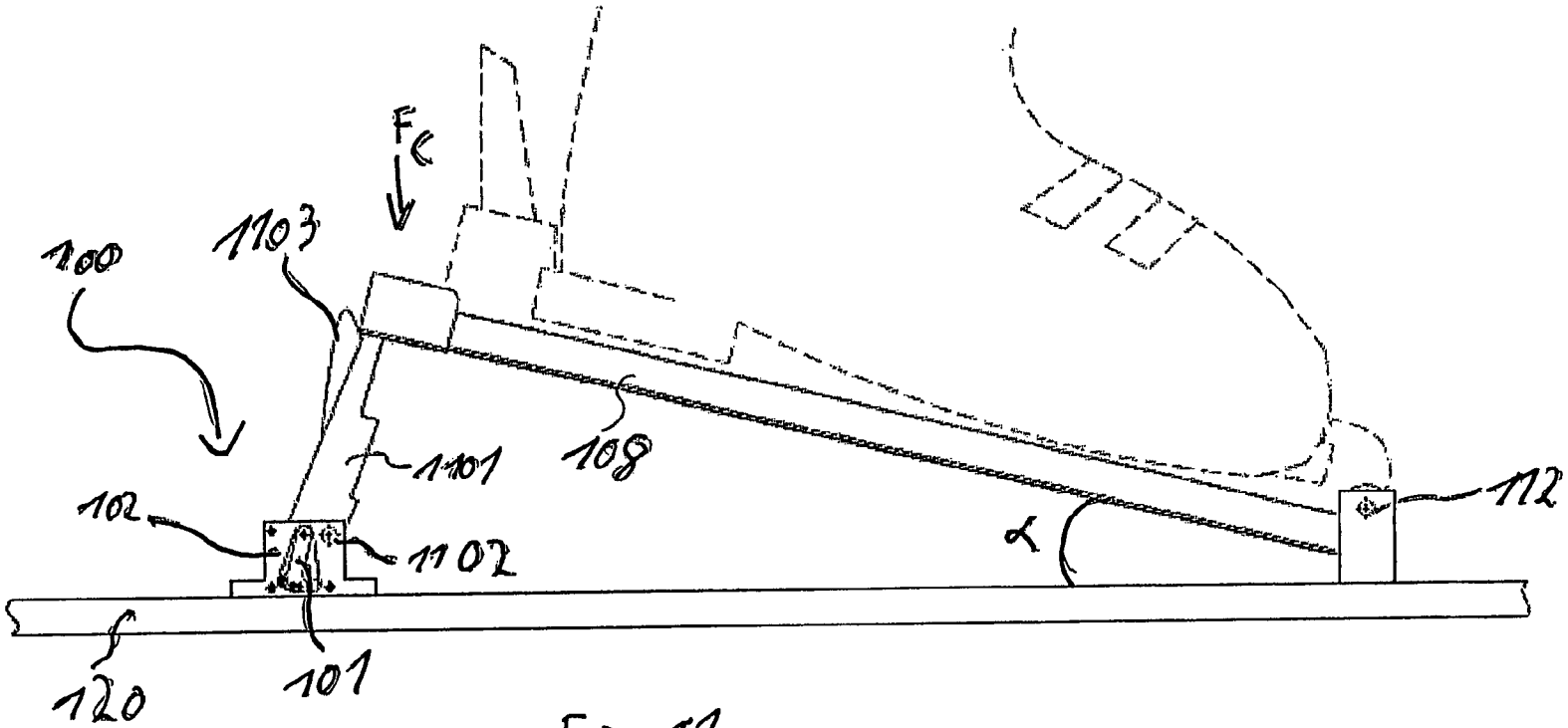
FIG. 11 shows a schematic view of the heel elevator device comprising a strut element and a guiding element according to an exemplary embodiment of the invention.

FIG. 11 shows an exemplary embodiment of the heel elevator device 100, wherein a strut element 1101 and a guiding element 1103 are attached to the supporting element 102. The strut element 1101 and the guiding element 1103 are attached to the supporting element 102 rotatably around a strut rotating axis 1102. The strut element 1101 and the guiding element 1103 extend from the supporting element 102 to the plate element 108 and are adapted to be coupled to the plate element 108. The plate element may be attached to the ski 120 by an attachment element comprising the rotary axis 112 of the plate element 108. The rotary axis 112 may be located in the toe (front) part of the plate element 108, wherein the coupling section of the plate element 108 adapted for coupling to the strut element 1101 and to the guiding element 1103 may be located in the heel (back) part of the plate element 108.

In FIG. 11, the strut element 1101 is coupled to the plate element 108 in such a way that the climbing force Fc is exerted to the strut element 1101, wherein a part of the climbing force Fc is transferred from the strut element 1101 to the supporting element 102 and another part of the climbing force Fc is transferred to the pendulum element 101 via the connection rod 802 and the force transmitting piston 805. In this coupled state of the strut element 1101 and the plate element 108, the pendulum element 101 is rigidly fixed, respectively torque-proof fixed, to the supporting element 102, so that the ski 120 and the plate element 108 provide a fixed climbing angle $\alpha$.

Figure 12:
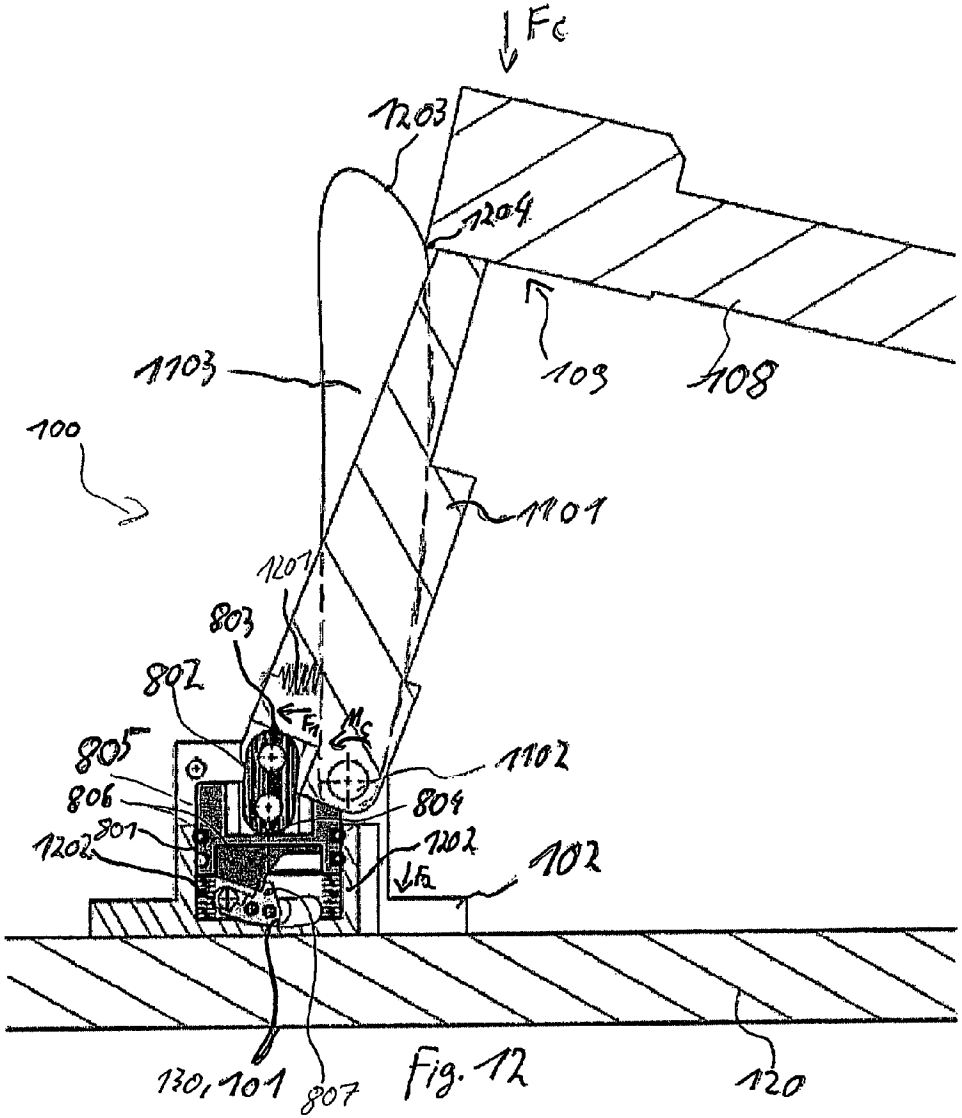
FIG. 12 shows a detailed view of the embodiment shown in FIG. 11, wherein the strut element and the plate element are shown in a coupled state according to an exemplary embodiment.

FIG. 12 illustrates a detailed view of the heel elevator device shown in FIG. 11. In FIG. 12, the strut element 1101 and the plate element 108 are shown in a coupled state, so that the climbing force Fc is transferred from the plate element 108 over the strut element 1101 to the pendulum element 101 into the supporting element 102. Hence, in the coupled state, the pendulum element is torque-proof fixed.

Moreover, in FIG. 12, the guiding element 1103 is shown in more detail. The guiding element 1103 comprises a guiding profile 1203. When the climbing force Fc is exerted to the plate element 108, the plate element 108 rotates around the rotary axis 112, so that the backside respectively the heel side of the plate element 108 moves in the direction to the ski 120. When the plate element 108 moves to the direction to the ski 120, a contact edge 1204 of the plate element 108 get in contact with the guiding profile 1203. The movement of the plate element 108 forces by the contact of the contact edge 1204 with the guiding profile 1203 the guiding element 1103 to rotate around the strut rotating axis 1102 counter clockwise. When the guiding element 1103 is moved counterclockwise around the strut rotating axis 1102, the guiding element 1103 forces the strut element 1101 to rotate around the strut rotating axis 1102 with the strut rotary movement Ms counterclockwise as well. The rotary force of the guiding element 1103 may be transferred to the strut element 1101 by a first spring 1201.

The shape of the guiding profile 1203 of the guiding element 1103 defines the rotary movement respectively the strut rotary movement of the strut element 1101. Thus, due to a predetermined design of the guiding profile 1203 of the guiding element 1103, a predetermined alignment and coupling position of the strut element 1101 with the plate element 108 may be provided. I.e. even for a variety of different climbing angles α respectively a variety of different inclinations of hill sizes, always a predefined coupling position with the strut element 1101 and the plate element 108 may be provided.

When the strut element 1101 is coupled with the plate element 108, the climbing force Fc is transferred to the supporting element 102 via the strut element 1101, wherein another (smaller) part of the climbing force Fc is transferred to the connection rod 802, e.g. by the rotation of the strut element 1101. This part of the climbing force Fc may be transferred to the connection rod 802 by the strut rotary movement Ms of the strut element 1101, wherein the main part of the climbing force Fc may be transferred directly to the supporting element 102 via the strut rotating axis 1102.

The part of the climbing force Fc that is transferred to the connection rod 802 forces the force transmitting piston 805 to move to the direction of the engagement element 807 of the pendulum element 101. The piston engaging section 806 fixes the pendulum element 101 by engaging the engagement element 807. When the piston engaging section 806 is in contact with the engagement element, the pendulum element 101 is torque-proof fixed, so that a further rotation of a pendulum element 101 is prevented. Then, a further rotation of the strut element 1101 around the strut rotating axis 1102 is not longer possible, so that the movement of the plate element 108 is also prevented and a fixed climbing angle α is adjusted. With other words, the fixation of the gravity aligned pendulum element 101 leads to the predefined fixed climbing angle α.

Figure 13:
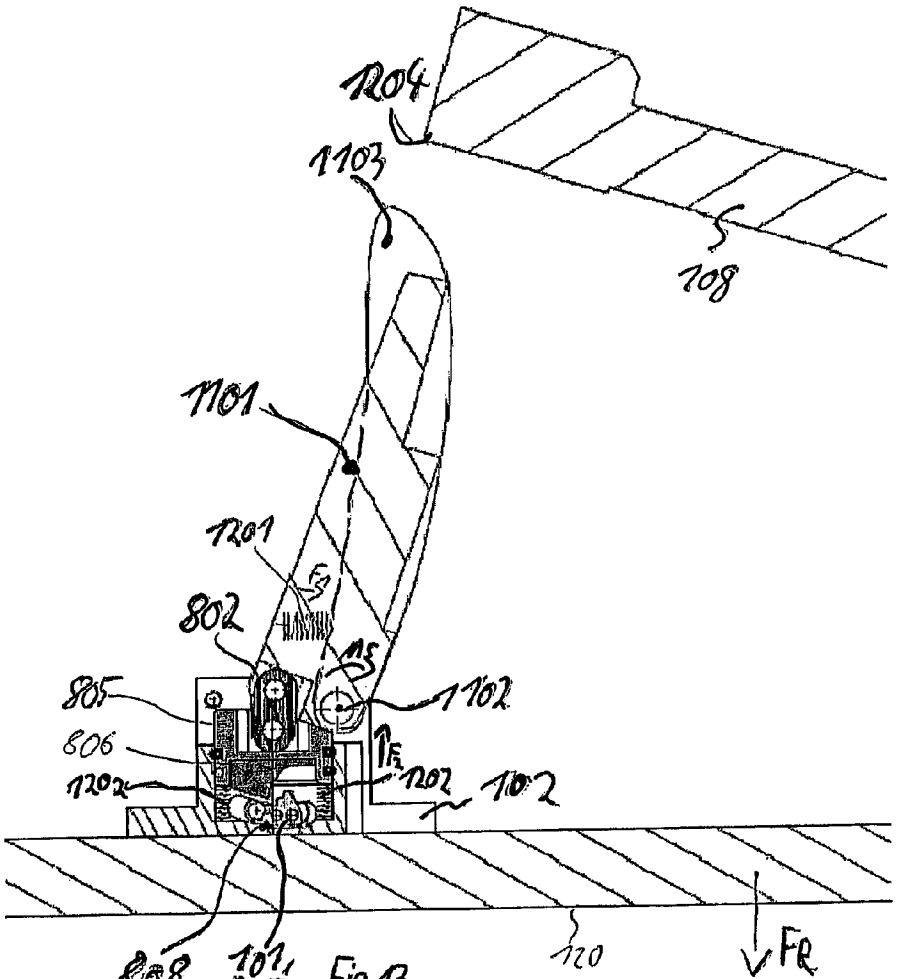
FIG. 13 shows a schematic view of the heel elevator device, wherein the strut element and the guiding element are decoupled from the plate element according to an exemplary embodiment.

FIG. 13 shows a detailed view of the heel elevator device 100 with a similar exemplary embodiment as shown in FIG. 12, wherein the load releasing force Fr is exerted and the pendulum element 101, the strut element 1101 and the guiding plate element 108 are shown in a decoupled state. This decoupled state is provided when the ski driver lifts his feet for conducting the next step, wherein during the decoupled state, the pendulum element 101 may be aligned to gravity, so that a new climbing angle α may be adjusted. Then, the retaining spring 1202 moves the force transmitting piston 805 away from the pendulum element 101, so that the piston engaging section 806 and the engagement section 807 are decoupled. Moreover, when the load releasing force Fr is exerted, the gap 808 between the engagement element 807 of the pendulum element 101, and thus the pendulum element 101 itself, and the supporting element 102 may be provided. Thus, the pendulum element 101 is pivotable again and is adapted for being adjusted to gravity. The movement of the force transmitting piston 805 lifts as well the connection rod 802, and thus the strut element 1101 is forced to move clockwise with its strut rotary movement Ms around the strut rotating axis 1102 until a start position is achieved. The start position may be defined by a stopper element, so that the strut element rotates clockwise around the strut rotating axis 1102 until the stopper element is reached. The clockwise strut rotary movement Ms may further be transferred by the first spring to the guiding element 1103, so that also the guiding element 1103 rotates around the strut rotating axis 1102 until the start position is achieved again. Furthermore, the spring force of the first spring 1201 may be larger than the spring force of the retaining spring 1202.

Thus, a start configuration of the heel elevator device 100 is achieved, so that when the climbing force Fc is exerted again to the plate element 108, a coupling may be re-established as explained already in FIG. 12. Thus, a heel elevator device 100 may be provided, including an adjustment mechanics that provides an adjustment of the climbing angle α for a variety of different inclinations of mountains with an automatic configuration of the climbing angle α.

Figure 15:
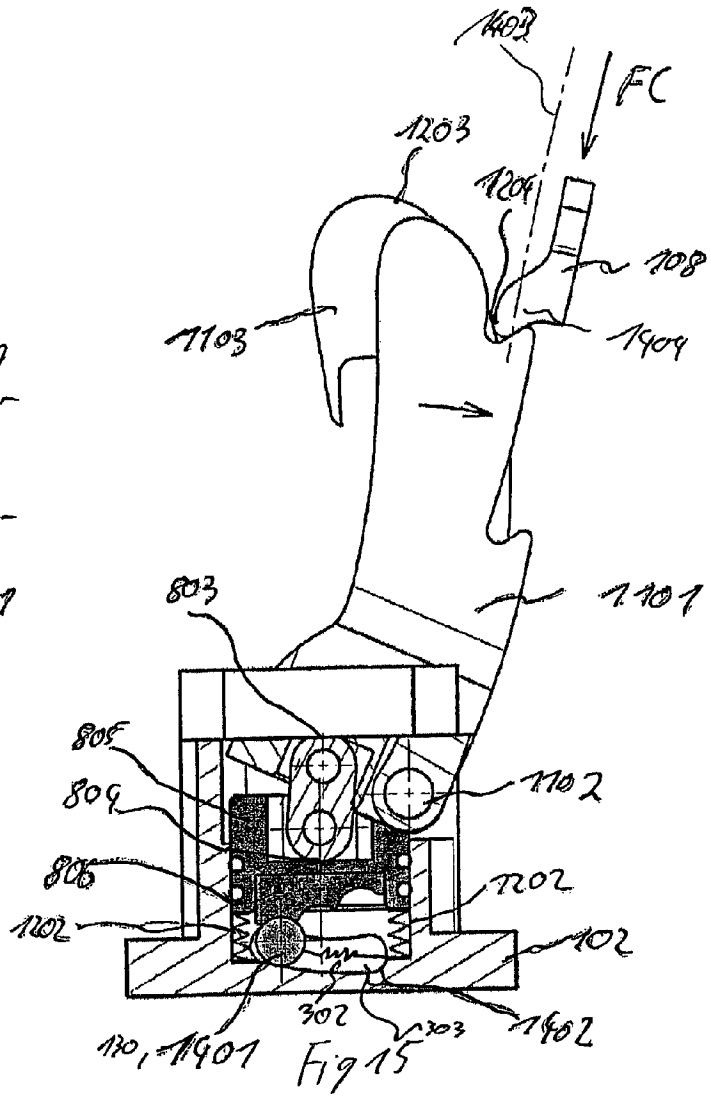
FIG. 14 and FIG. 15 show a schematic view of an exemplary embodiment with a rolling body.
Figure 14:
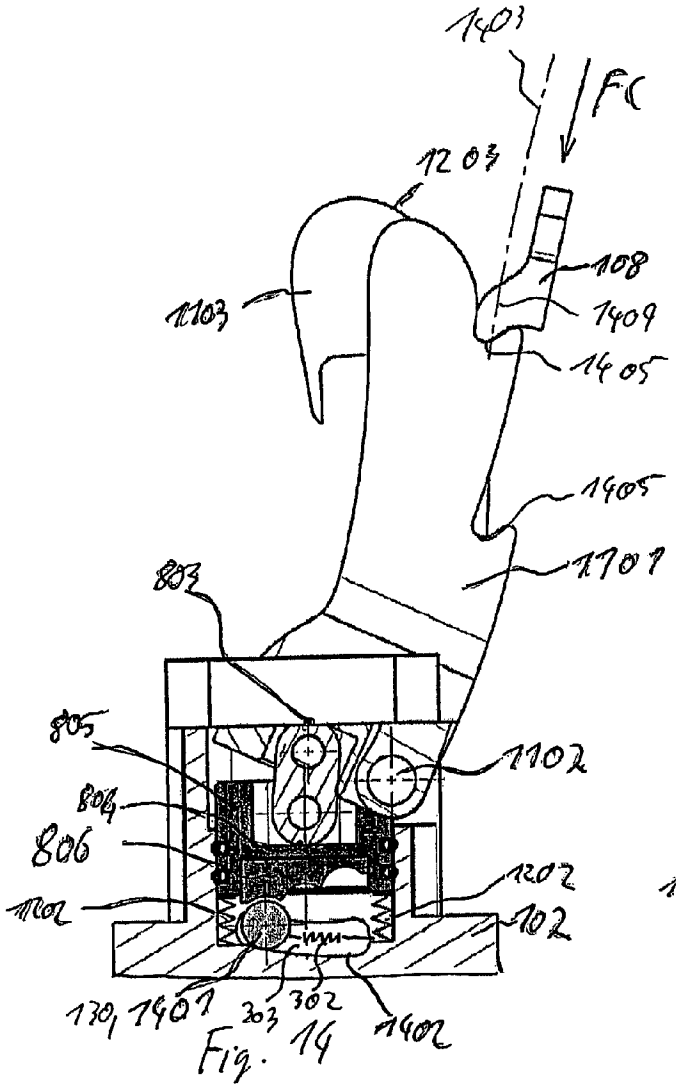

FIG. 14 and FIG. 15 show an exemplary embodiment of the heel elevator device 100 comprising a roller body, such as a rolling body 1401, which is rollable on a roller surface 1402. The roller surface may be liner or curve-shaped as illustrated in FIG. 14 and FIG. 15. The rolling body 1401 may engage into respective recesses of the piston engaging section 806 of the force transmitting piston 805. Moreover, vibration absorber devices 302 may be attached to the rolling body 1401, so that a movement of the rolling body 1401 may be damped. The vibration absorber device 302 is adapted for absorbing a vibration and oscillation of the rolling body 1401 when aligning to gravity. The vibration absorber device 302 may comprise an isolated chamber 303 wherein the isolated chamber 303 isolates at least a part of the rolling body 1401. The isolated chamber 303 may comprise a fluid through which the rolling body 1401 may be moved. The fluid in the isolated chamber provides a counterforce in an opposite direction to the movement of the rolling body 1401. Thus, the movement of the rolling body 1401 may be slowed down, so that vibrations or oscillations may be reduced and the rolling body 1401 may be aligned to gravity in a shorter time. The vibration absorber devices 302 may also comprise a spring or foam for exerting the counterforce (damping force).

The rolling body 1401 is engageable to the engaging section 806 of the force transmitting piston 805, wherein the shape of the engaging section 806 may correspond to the shape of the rolling body 1401. The rolling body 1401 may comprise a ball shape or a cylindrical shape. Moreover, FIG. 14 and FIG. 15 show an exemplary embodiment of the strut element 1101 and the guiding element 1103.

Furthermore the plate element 108 is shown, wherein the plate element 108 comprises an engagement plug 1404 that comprises the contact edge 1204 with the guiding element 1103. The plate element 108 may comprise the sole of the ski boot, wherein the engagement plug 1404 may be detachably connected to the sole. In other words, the engagement plug 1404 may be for instance a (metal) insert, adapted for being attached to the plate element 108, i.e. the sole of the ski boot.

A cam track 1403 is shown that illustrates the movement of the binding plate 108 and thus the contact edge 1204 around the rotary axis 112 of the plate element 108. The contact edge 1204 moves along the guiding profile 1203 until the engagement plug 1404 is engaged with the engagement cavity 1405 of the strut element 1101. Then, the climbing force Fc may be transmitted from the plate element 108 to the strut element 1101 and further to the strut rotary axis 1102 to the supporting element 102.

The position of the strut element 1101 when transmitting the climbing force Fc may be defined in such a way, that when the climbing force Fc is transmitted, the force transmitting piston 805 is already moved away from a gravity based positioning element 130. I.e. when a climbing force Fc is transmitted due to a step up the hill, the gravity based positioning element 130 may be already in the decoupled state and may be already movable and may thus be realigned to a new inclination of the hill. Thus, the available adjustment time for the gravity based positioning element 130 to align to gravity may be increased. As shown in FIG. 14, the engagement plug 1404 is in contact with the engagement cavity 1405 for transmitting the climbing force Fc, whereas the piston engaging section 806 of the force transmitting piston 805 is decoupled from the gravity based positioning element 130. Thus, the gravity based positioning element 130 may already be aligned to gravity. This may be achieved due to the design of the engagement cavity 1405, the design of the strut element 1101, the guiding element 1103 and/or the determination of the movement of the plate element 108 along the cam track 1403.

Figure 16:
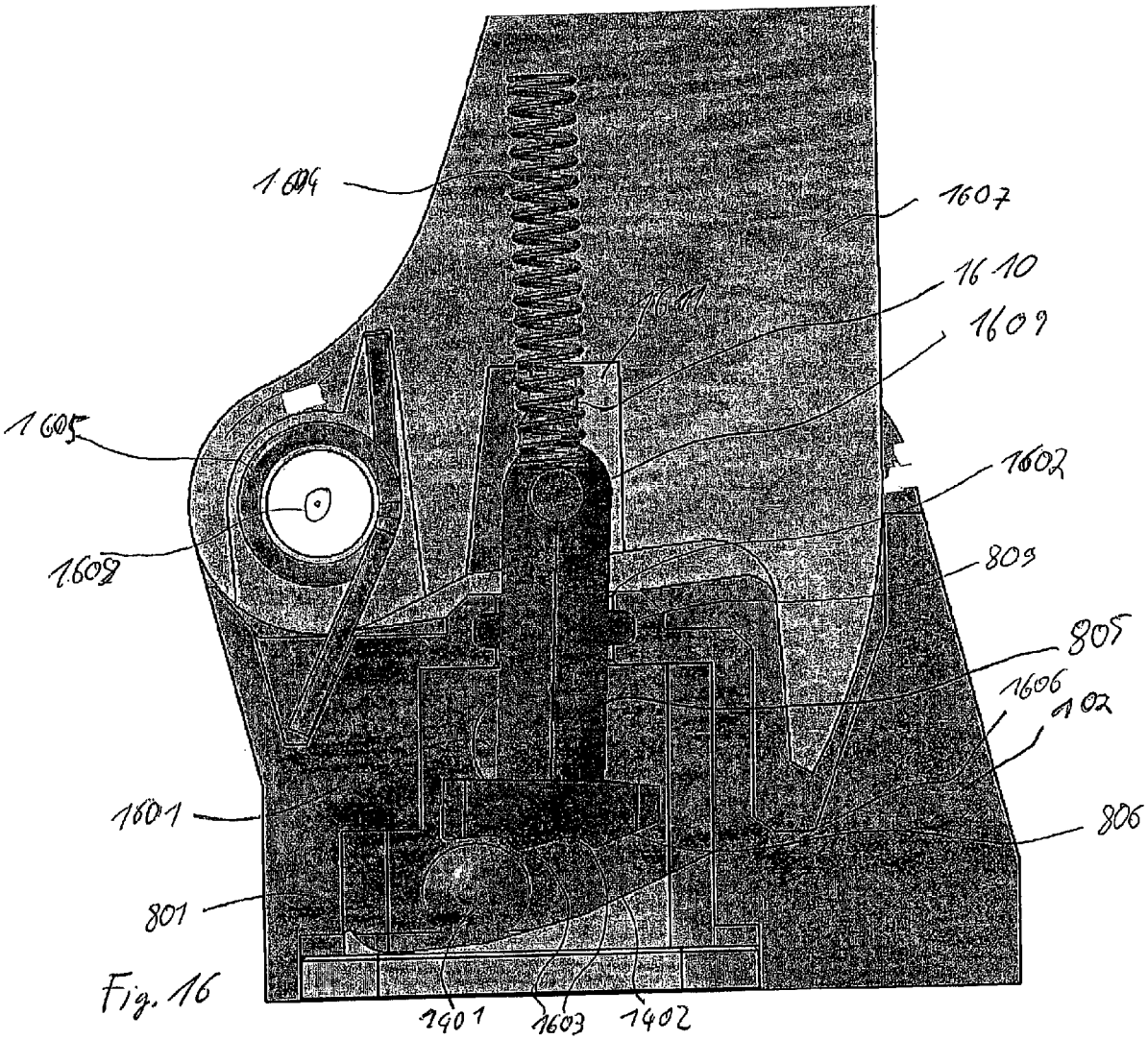
FIG. 16 to FIG. 18 show a further view of an exemplary embodiment with the rolling body and a retainer.

FIG. 16 illustrates a detailed view of a further exemplary embodiment of the present invention. The gravity based positioning element 130 is shown in the form of the rolling body 1401, such as a ball. The rolling body 1401 is freely movable in the supporting section 801 and is rollable in particular along the rolling surface 1402. The force transmitting piston 805 comprises the piston engaging section 806. The piston engaging section 806 comprises a plurality of piston recesses 1603. The rolling body 1401 is engageable with one of the piston recesses 1603, when the force transmitting piston 805 is moved in an engagement position. When the force transmitting piston 805 is moved into a releasing position, so that the rolling body 1401 is freely movable, the rolling body 1401 is rollable along the rolling surface 1402 as long as the rolling body 1401 is aligned to the direction of the gravity. The position of the rolling body 1401 on the rolling surface 1402 is affected by the direction of gravity, the inclination and the shape of the rolling surface 1402 and the orientation of the supporting element 102 and thus the orientation of the ski 120 and the inclination of the mountain, to which the ski 120 is aligned. Depending on the position of the rolling body 1401 on the rolling surface 1402, the force transmitting piston 805 engages with an assigned recess 1603 the rolling body 1401. In the engagement position of the force transmitting piston 805, the position of the rolling body 1401 defines the relative position of the force transmitting piston 805 with respect to the supporting element 102. The relative position of the force transmitting piston 805 with respect to the supporting element 102 defines furthermore the relative position of a retainer 1607 with respect to the supporting element 102.

The retainer 1607 is rotatably connected to the supporting element 102, so that the retainer 1607 is rotatable around a retainer rotating axis 1608. A connection may be provided by a pin or a bolt, wherein the climbing force that is exertable to the retainer 1607 by the plate element 108 is transferred by the balls from the retainer 1607 to the supporting element 102.

Moreover, the force transmitting piston 805 engages, e.g. with a pin or a bolt 1609, a guide slot 1610 inside a through-hole 1611 of the retainer 1607, so that the fore transmitting piston 805 is longitudinally moveable with respect to the retainer 1607. Thus, if the retainer 1607 moves away from the plate element 108 for disengaging the plate element 108, the movement is not blocked by the force transmitting piston 805, when the force transmitting piston 805 is in the engagement position with the rolling body 1401. If the force transmitting piston 805 is fixed to the retainer 1607 without providing a longitudinal movement with respect to the retainer 1607, the retainer may only rotate as long as the force transmitting piston 805 is not engaged with the rolling body 1401 and thus blocked.

Moreover, FIG. 16 shows a further spring 1604 that is coupled to and connected between the force transmitting piston 805 and the retainer 1607. If the retainer 1607 rotates around the retainer rotating axis 1608 in the direction to the force transmitting piston 805 as indicated by the arrow in FIG. 16, the further spring 1604 exerts a spring load (i.e. a compressive force) to the force transmitting piston 805 and forces the force transmitting piston 805 into its engagement position. The spring load defines in that case the engagement force. Alternatively or additionally, the gravitational force of the force transmitting piston 805 moves the force transmitting piston 805 into its engagement position. The gravitational force then acts as the engagement force for moving the force transmitting piston 805.

If a further spring load of the further spring 1604 acts in an opposite direction to the spring load, the force transmitting piston 805 is moved into its releasing position, so that the rolling body 1401 is freely movable again.

Alternatively or additionally the guide slot comprises an offset or an insert is installable inside the guide slot 1610 for limiting a movement of the force transmitting piston 805 away from the retainer 1607. The offset or the insert moves (lifts) the force transmitting piston 805, if the retainer 1607 moves in the direction to the plate element 108.

Moreover, FIG. 16 shows a torsion spring 1605 that is connected to the supporting element 102 and adapted for exerting a torsional force to the retainer 1607 for rotating the retainer 1607 around the retainer rotating axis 1608 in a direction away from the plate element 108 and to the force transmitting piston 805 as indicated by the arrow.

Torsion spring 1605 forces the retainer 1607 to rotate in a first direction, until the retainer rotation is blocked by a block section 1606 of the supporting element 102 or until the further spring force of the further spring 1604 counteracts to the torsion force, i.e. until the further spring load of the further spring 1604 is equal or higher than the torsion force.

The further spring 1604 presses the force transmitting piston 805 against the offset or the insert of the retainer 1607, so that a defined and continuous relative position between the retainer 1607 and the force transmitting piston 805 is realized. Thus, the position of the force transmitting piston 805 adjusted by the rolling body 1401 defines the position of the retainer 1607 as well.

Moreover, the amount of the further spring force of the further spring 1604 is adjustable by the relative position of the force transmitting piston 805 with respect to the supporting element 102. The relative position of the force transmitting piston 805 with respect to the supporting element 102 is dependent on the relative position of the rolling body 1401 inside the supporting element, i.e. inside the supporting section 801. Thus, by the alignment of the rolling body 1401 to gravity and by the inclination of the rolling surface 1402, the relative position of the force transmitting piston 805 is adjustable and for this reason also the amount of the further spring force and thus the relative position of the retainer 1607 are adjustable.

Moreover, the force transmitting piston 805 extends through a through-hole 1602 of the supporting element 102. Between the surface of the through-hole 1602 and the force transmitting piston 805 the sealing ring 809 may be interposed. The sealing ring 809 seals the inside of the supporting section 801 to the outside, even when the force transmitting piston 805 moves relatively to the through-hole 1602.

Inside the supporting section 801 a liquid tight chamber may be formed. In the liquid tight chamber a fluid may be inserted through which the rolling body 1401 is moved. The fluid in the fluid tight chamber may provide a predefined viscosity, so that the free movement of the rolling body 1401 may be damped in a predefined manner.

Additionally, inside the supporting section 801 or the liquid tight chamber a compensation element 1601 is installed. When the force transmitting piston 805 moves inside the liquid tight chamber, the compensation element 1601 reduces its volume, so that a fluid pressure inside the fluid tight chamber is kept unchanged. On the contrary, when the force transmitting piston 805 moves outside of the liquid tight chamber, the compensation element 1601 increases its volume, so that no low pressure of the fluid occurs and the fluid pressure inside the fluid tight chamber may be kept equal.

Between the piston engaging section 806 and the inner wall of the supporting section, i.e. the liquid tight chamber, a gap is provided, so that the fluid is flowable from one side of the piston engaging section 806 to the other, in order to compensate the movement of the force transmitting piston 805.

Moreover, FIG. 16 shows the block section 1606 wherein the block section 1606 is adapted for limiting the rotation of the retainer 1607.

Figure 17:
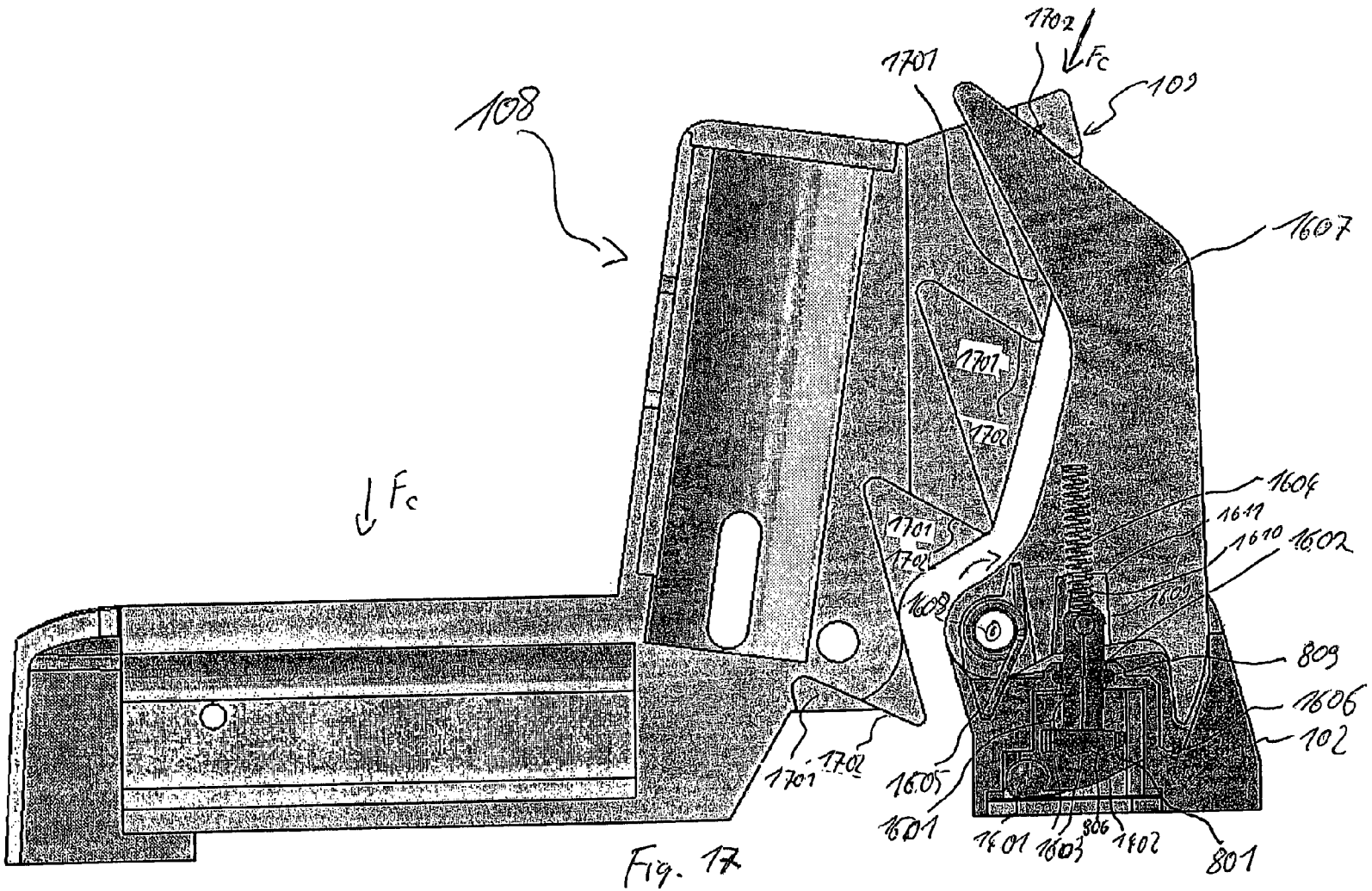
Figure 18:
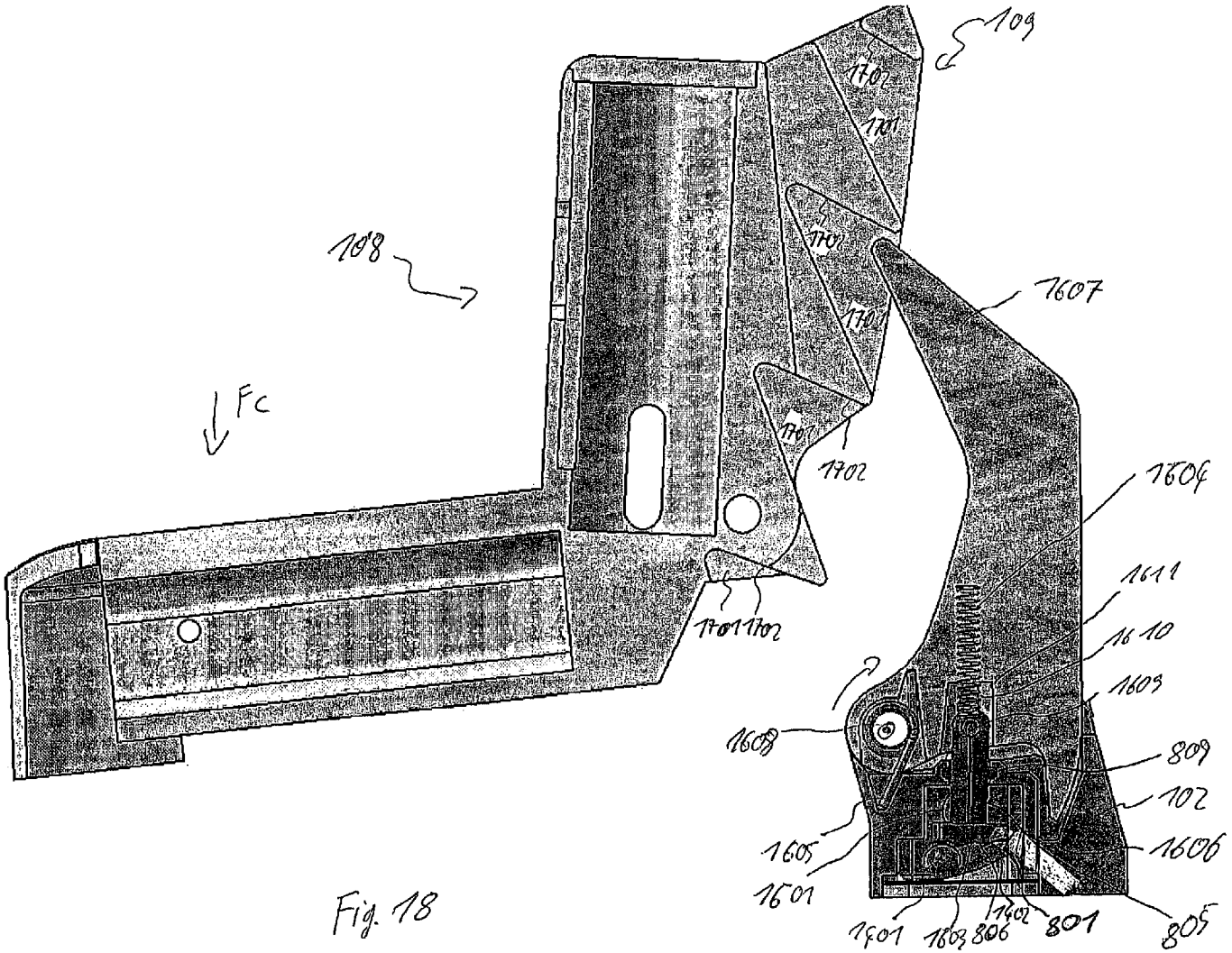

FIG. 17 and FIG. 18 show an exemplary embodiment of the heel elevator device 100 wherein in FIG. 17 a first climbing angle $\alpha$ and in FIG. 18 a second climbing angle $\alpha$ is adjusted.

FIG. 17 and FIG. 18 also show the compensation element 1601 that is installed in the supporting section 801 for compensating the volume change supporting section 801 when the force transmitting piston 805 changes its position. Moreover, the block section 1606 is shown that prevents the retainer 1607 to rotate around the retainer rotating axis 1608 in an undesired position.

FIG. 17 and FIG. 18 show the plate element 108 which is a part of a ski binding or the ski shoe itself. When the skier steps onto to the plate element 108, the climbing force Fc is exerted to the plate element 108 and the plate element 108 moves in the direction to the retainer 1607 and the supporting element 102.

The plate element 108 comprises a plurality of recesses 1701. Each recess 1701 is formed at a predefined position of the plate element 108, wherein each predefined position of the recesses 1701 defines a predefined climbing angle $\alpha$ when being engaged with the retainer 1607. Into each recess 1701 the retainer 1607 may be engaged, when the skier steps onto the plate element 108.

The recess 1701 with which the retainer 1607 is engaged is dependent on the relative position of the retainer 1607 with respect to the supporting element 102.

As already described in the description of FIG. 16, the position of the retainer 1607 with respect to the supporting element 102 is dependent on the relative position of the force transmitting piston 805 with respect to the supporting element 102. Furthermore, the relative position of the force transmitting piston 805 with respect to the supporting element 102 is dependent on the position of the rolling body 1401 inside the supporting section 801.

Moreover, in FIG. 17 and FIG. 18 guiding surfaces 1702 of each recess 1701 are shown. During the engagement phase of the retainer 1607 inside the recess 1701, the retainer 1607 is guided along the guiding surface 1702 until an end position is reached. The guiding surfaces 1702 are specifically formed in such a way that a smooth guiding of the retainer 1607 inside the recess 1701 and along the guiding surfaces 1702 is achievable. In other words, the first contact of the retainer with an assigned recess 1701 is provided by the adjustment of the position of the retainer. During a further movement of the plate element in the direction to the supporting element 102, the guiding surface 1702 of the assigned recess 1701 forces the retainer 1607 to move further inside the assigned recess 1701 until the end position is reaches. In the end position, the climbing force Fc is transferrable to the supporting element 102. In particular, the climbing force Fc is transferrable by a pin or a bolt that connects the retainer 1607 and the supporting element 102. Moreover, the rolling body 1401 and the force transmitting piston 805 are decoupled when the retainer 1607 is in the end position inside the assigned recess 1702, so that the climbing force Fc is explicitly transferred by the pin or bolt that connects the retainer 1607 and the supporting element 102.

FIG. 17 shows the plate element 108 in the end position with the retainer 1607. In the engaged position of the retainer 1607 with the plate element 108, the retainer 1607 is rotated around the retainer rotating axis 1608 in such a way, that the torsion spring 1605 is pretensioned.

The force transmitting piston 805 is connected to the retainer 1608 by the bolt 1609, wherein the bolt 1609 is slideably connected to the guide slot 1610 in the long hole 1611. Moreover, the offset or the insert for limiting the movement of the force transmitting piston 805 away from the retainer 1607 is formed or installed in the guide slot 1610.

If the retainer 1607 rotates to the plate element, the retainer 1607 lifts the force transmitting piston 805 into its releasing position, when the bolt 1609 contacts the offset or the insert. Additionally or alternatively, the further spring 1604 pulls with its further spring force the force transmitting piston 805 in its releasing position, wherein the piston engaging section 806 is disengaged with the rolling body 1401, so that the rolling body 1401 is freely movable inside the supporting section 801. In this position, the rolling body 1401 is alignable to the direction of gravity. In the position of the retainer 1607 as shown in FIG. 17, the retainer 1607 is engaged with the plate element 108 and the supporting element 102, so that no relative movement of the retainer 1607 occurs. Thus, the relative position of the retainer 1607 with respect to an assigned recess 1701 and thus with a relative position to the supporting element 102 defines a predefined climbing angle $\alpha$ that is dependent on the assigned recess 1701 into which the retainer 1607 is engaged.

FIG. 18 shows a position of the heel elevator device 100, wherein the skier has lifted his shoe and thus the plate element 108 for making a step. Thus, the plate element 108 is lifted and is disengaged with the retainer 1607. In this position, the torsion force of the torsion spring 1605 rotates the retainer 1607 around the retainer rotation axis 1608 as indicated by the arrow, i.e. in a direction away from the plate element 108 and in a direction to the supporting element 108.

The torsion force rotates the retainer 1607 as long as the retainer 1607 is blocked by the block section 1606. In particular, the force transmitting piston 805 is supported by the bolt 1609 in the guide slot 1610 for providing a longitudinal movement of the force transmitting piston 805 along the guide slot 1610. Thus, the rotation of the retainer 1607 is not blocked by the engagement position of the force transmitting piston 805. If the force transmitting piston 805 is fixed to the retainer 1607 without providing a longitudinal movement, the retainer 1607 rotates as long as the force transmitting piston 805 engages the rolling body 1401.

Moreover, the torsion force may rotate the retainer 1607 as long as the spring load of the further spring 1604 is lower than the torsion force. The amount of the spring load of the further spring 1604 is adjusted by the relative position of the force transmitting piston 805 with respect to the supporting element 102. As described above, the relative position of the force transmitting piston 805 with respect to the supporting element 102 is adjustable by the position of the rolling body 1401.

As shown in FIG. 18, due to the alignment of the ski and thus of the supporting element 102 with respect to the inclination of the hill, the rolling body 1401 is moved along the rolling surface 1402 until the rolling body 1401 is aligned to the direction of gravity. Thus, the force transmitting piston 805 engages with its assigned piston recess 1603 in the piston engaging section 806 the rolling body 1401. The position of the rolling body 1401 and the inclination of the rolling surface 1402 define the assigned piston recess 1603 and thus the relative position of the force transmitting piston 805. The relative position of the force transmitting piston 805 defines the relative position of the retainer 1607, because the spring load of the further spring 1604 presses the bolt 1609 of the force transmitting piston 805 against the offset or the insert, so that the force transmitting piston 805 and the retainer 1607 are as it where integrally formed.

FIG. 18 shows that by the alignment of the rolling body 1401, e.g. due to a higher inclination of the mountain and thus the ski 120, the retainer 1607 is in a position that is different with respect to the position shown in FIG. 17. For this reason, when the climber exerts the climbing force Fc again onto the plate element 108, so that the plate element 108 moves in the direction to the retainer 1607, the retainer 1607 engages in another assigned recess 1701 of the plate element 108. The engagement position of the retainer 1607 with the assigned recess 1701 defines a different climbing angle $\alpha$ as it is defined by the relative position of the retainer 1607 with the plate element 108 as shown in FIG. 17.

Hence, a climbing angle $\alpha$ is adjustable by the alignment of the rolling body 1401 without a further manual adjustment.

In the following further aspects of the invention are described.

According to a further aspect, the pendulum element 101 comprises a first pendulum part 1001, a second pendulum part 1002 and a pendulum rod 1003, wherein the first pendulum part 1001 and the second pendulum part 1002 are rotatably fixed to the supporting element 102, wherein the first pendulum part 1001 and the second pendulum part 1002 are connected by the pendulum rod 1003, wherein the engagement element 807 is fixed to the pendulum rod 1003.

According to a further aspect, the heel elevator device comprises a fixation device 103, wherein, when a climbing force Fc is exerted to the plate element 108 in a direction to the ski 120, the fixation device 103 is adapted for providing a fixation of the gravity based positioning element 130, wherein, when a load releasing force Fr is exerted to the plate element 108 in an opposite direction to the ski 120, the fixation device 103 is adapted for providing a movable fixation of the gravity based positioning element 130.

According to a further aspect the fixation device 103 comprises a bolt, wherein the bolt is fixed to the supporting element 102.

According to a further aspect the bolt is designed elastically.

According to a further aspect the heel elevator device comprises a floating pin 104 for pivotably supporting the pendulum element 101, wherein the floating pin 104 is adapted for floatably fixing the pendulum element 101, so that, when the climbing force Fc is exerted, the pendulum element 101 is moved in the direction to the fixation device 103 for being torque proof and, when the load releasing force is exerted, the pendulum element 101 is moved away from the fixation device 103, so that the pendulum element 101 is pivotable.

According to a further aspect the heel elevator device comprises an elastic bearing ring 105, wherein the pendulum element 101 is mounted floatably to the floating pin 104 by the elastic bearing ring 105.

According to a further aspect the heel elevator device comprises a vibration absorber device 302, wherein the vibration absorber device 302 is adapted for absorbing a vibration of the gravity based positioning element 130.

According to a further aspect the vibration absorber device 302 comprises an isolated chamber 303, wherein the isolated chamber 303 is adapted for surrounding at least a part of the gravity based positioning element 130, wherein the isolated chamber 303 comprises a fluid.

the pendulum element 101 comprises an alignment pendulum 310 and a supporting pendulum 110, wherein the alignment pendulum 310 and the supporting pendulum 110 are coupled, wherein the alignment pendulum 310 is adapted for being aligned to gravity, wherein the supporting pendulum 110 is adapted for fixing the plate element 108 in a fixed minimum climbing angle $\alpha$ with respect to the ski 120.

According to a further aspect the alignment pendulum 310 comprises a first fixation section 304 with a first rotary axis 305 and a weight section 306, wherein the alignment pendulum 310 is fixed to the supporting element 102 pivotable around the first rotary axis 305, wherein a center of gravity of the alignment pendulum 310 is located in the weight section 306 for providing a lever arm 308 with respect to the first rotary axis 305.

According to a further aspect the vibration absorber device 302 is adapted for completely enveloping the alignment pendulum 310.

According to a further aspect the alignment pendulum 310 comprises a weight element 301 in the weight section 306.

According to a further aspect the supporting pendulum 110 comprises a second fixation section 107 with a second rotary axis 113 and an engagement section 106 for being engaged with the ski binding 140, wherein the supporting pendulum 110 is fixed to the supporting element 102 pivotable around the second rotary axis 113, wherein a center of gravity of the supporting pendulum 110 is located in the second fixation section 107.

According to a further aspect the alignment pendulum 310 and the supporting pendulum 110 are coupled magnetically.

According to a further aspect, the heel elevator device comprises a decoupling device, wherein the decoupling device is adapted for decoupling the alignment pendulum and the supporting pendulum 110 when activating the decoupling device.

According to a further aspect, the heel elevator device comprises the plate element 108 adapted for being fixed pivotable to the supporting element 102, wherein the plate element 108 comprises a receiving section 109, wherein the receiving section 109 is adapted for engaging an engagement section 106 of the pendulum element 101, wherein the engagement section 106 is adapted for being engaged in the receiving section 109 when the climbing force Fc is exerted, so that the pendulum element 101 is torque proof fixed, wherein the receiving section 109 is adapted for engaging the engagement section in different climbing angles $\alpha$, wherein the engagement section 106 provides a constant rigid angle $\beta$ with respect to the receiving section 109.

According to a further aspect, the heel elevator device comprises a retaining spring 1202, wherein the retaining spring 1202 is attached between the supporting element 102 and the force transmitting piston 805 in such a way, that, when the load releasing force Fr is exerted, the force transmitting piston 805 moves slidably into a releasing position, wherein, in the releasing position, the piston engaging section 806 is decoupled of the gravity based positioning element 130, so that the gravity based positioning element 130 is movable.

According to a further aspect the force transmitting piston 805 comprises a sealing ring 809.

According to a further aspect, the heel elevator device comprises a strut element 1101, wherein the strut element 1101 is adapted for being engaged to the plate element 108 for transmitting the climbing force Fc, wherein the strut element 1101 is connected rotatably around a strut rotating axis 1102 to the supporting element 102 in such a way, that, when exerting the climbing force Fc, the strut element 1101 is adapted for rotating with a strut rotary movement Ms around the strut rotating axis 1102 and is adapted for transmitting at least a part of the climbing force Fc to the connection rod 802.

According to a further aspect, the heel elevator device comprises a guiding element 1103, and a first spring 1201 attached to the guiding element 1103, wherein the guiding element 1103 is connected rotatably around the strut rotating axis 1102 to the supporting element 102, wherein the guiding element 1103 is adapted for providing a guiding rotary movement when the plate element 108 moves in the direction to the supporting element 102 and engages the guiding element 1103, wherein the first spring 1201 is adapted for exerting a spring force to the strut element 1101 in such a way, that the guiding rotary movement of the guiding element 1103 forces the strut element 1101 to conduct the strut rotary movement Ms.

According to a further aspect the plate element 108 comprises a stopper section 111, wherein the stopper section 111 is adapted for being in contact with the ski 120 at a maximum climbing angle $\alpha$ for preventing further rotation of the plate element 108.

According to a further aspect, the heel elevator device comprises the sealing ring 809, wherein the sealing ring 809 is mountable to the supporting section 801 in such a way, that the sealing ring 809 seals the liquid-tight chamber.

According to a further aspect the fluid comprises a viscosity of 1 mPa·s to 106 mPa·s.

According to a further aspect the supporting section 801 comprises a through-hole 1602 connecting the inside of the liquid-tight chamber to the outside, wherein the through-hole 1602 is adapted for supporting the force transmitting piston 805 slideably, wherein the sealing ring 809 is interposed between the force transmitting piston 805 and the through-hole 1602.

According to a further aspect, the heel elevator device comprises the ski 120, wherein the heel elevator device 100 is fixed to the ski 120.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

LIST OF REFERENCE SIGNS

100 heel elevator device
101 pendulum element
102 supporting element
103 fixation device
104 floating pin
105 elastic bearing ring
106 engagement section
107 second fixation section
108 plate element
109 receiving section
110 supporting pendulum
111 stopper section
112 rotary axis of the plate element
113 second rotary
114 first magnet element
120 ski
130 gravity based positioning element
140 ski binding
301 weight element
302 vibration absorber device
303 isolated chamber
304 first fixation section
305 first rotary axis
306 weight section
307 center of gravity of alignment pendulum
308 lever arm
309 second magnetic element
310 alignment pendulum
401 transparent side wall
601 ski boot
801 supporting section
802 connection rod
803 first force transmission section
804 second force transmission section
805 force transmitting piston
806 piston engaging section
807 engagement element
808 gap
809 sealing ring
1001 first pendulum part

1002 second pendulum part
1003 pendulum rod
1101 strut element
1102 strut rotating axis
1103 a guiding element
1201 first spring
1202 retaining spring
1203 guiding profile
1204 contact edge
1401 rolling body
1402 rolling surface
1403 cam track
1404 engagement plug
1405 engagement cavity
1601 compensation element
1602 through hole
1603 piston recess
1604 further spring
1605 torsion spring
1606 block section
1607 retainer
1608 retainer rotating axis
1609 bolt
1610 guide slot
1611 long hole
1701 recess
1702 guiding surface
Fc climbing force
Fr load releasing force
F1 spring travel direction of first spring
F2 spring travel direction of retaining spring
Ms strut rotary movement
G direction of gravity
α climbing angle
β rigid angle

The invention claimed is:

1. A heel elevator device for a ski, wherein the heel elevator device is adapted for being fixed to the ski and adapted for connecting a plate element to the ski, wherein the plate element comprises a ski binding or a sole of a ski boot, the heel elevator device comprising:

a supporting element with a supporting section, a gravity based positioning element movably supported in the supporting element, and a force transmitting piston with a piston engaging section, wherein the force transmitting piston is slideably attached to the supporting section in such a way that, when an engagement force is exerted, the force transmitting piston moves slideably into an engagement position, wherein, in the engagement position, the piston engaging section is engaged with the gravity based positioning element for fixing the gravity based positioning element, wherein, when the gravity based positioning element is fixed, the gravity based positioning element is adapted for adjusting a fixed minimum climbing angle of the plate element with respect to the ski, and, when the gravity based positioning element is movably supported in the supporting element, the gravity based positioning element is adapted for being aligned to gravity.

2. The heel elevator device of claim 1, further comprising, a connection rod with a first force transmission section and a second force transmission section, wherein the connection rod is rotatably fixed to a receiving section of the plate element and to the supporting section of the supporting element, wherein the first force transmission section is adapted for receiving a climbing force by a force closure from the receiving section, and wherein the second force transmission section is adapted for transferring the climbing force by a force closure to the supporting section, wherein the force for slideably moving the force transmitting piston into the engagement position is at least a part of the climbing force, wherein the gravity based positioning element is movably fixed to the supporting element wherein, when the plate element and the ski are rigidly coupled, the gravity based positioning element is fixed to the supporting element and the gravity based positioning element is adapted for fixing the plate element in a fixed minimum climbing angle with respect to the ski, and wherein, when the plate element and the ski are decoupled, the gravity based positioning element is movably fixed to the supporting element, so that the gravity based positioning element is adapted for being aligned to gravity.

3. The heel elevator device of claim 1, wherein the gravity based positioning element comprises a pendulum element rotatably fixed to the supporting element, wherein, when the plate element and the ski are rigidly coupled, the pendulum element is torque proof fixed to the supporting element and the pendulum element is adapted for fixing the plate element in a fixed minimum climbing angle with respect to the ski, and wherein, when the plate element and the ski are decoupled, the pendulum element is pivotably fixed to the supporting element, so that the pendulum element is adapted for being aligned to gravity.

4. The heel elevator device of claim 3, wherein the pendulum element is rotatably fixed to the supporting element in such a way that, when climbing force is exerted, an engagement element of the pendulum element is in frictional contact with the supporting element, and, when the load releasing force is exerted, a gap between the engagement element and the supporting element is provided.

5. The heel elevator device of claim 1, wherein the gravity based positioning element comprises a rolling body, in particular a ball, wherein the supporting element comprises a rolling surface, wherein the rolling body is rollable along the rolling surface.

6. The heel elevator device of claim 5, wherein the supporting section comprises a liquid-tight chamber in which the rolling body and a part of the force transmitting piston is embedded.

7. The heel elevator device of claim 5, wherein the liquid-tight chamber comprises a fluid for damping a movement of the rolling body.

8. The heel elevator device of claim 6, wherein the supporting section comprises a compensation element, wherein the compensation element is located inside the liquid-tight chamber, and wherein the compensation element is adapted for being compressed by the force transmitting piston for amending a fluid volume of the liquid-tight chamber.

9. The heel elevator device of claim 5, wherein the piston engaging section comprises piston recesses for engaging the rolling body in the engagement position, wherein depending on the relative position of the rolling body with respect to the force transmitting piston, the rolling body is engageable with an assigned one of the piston recesses, wherein the piston recesses are aligned in the piston engaging section in such a way, that depending on an engagement of the rolling body with an assigned piston recess, the relative position of the force transmitting piston with respect to the supporting element is defined.

10. The heel elevator device of claim 5, further comprising a retainer, wherein the retainer is rotatable connected with the supporting element and rotatable around the retainer rotating axis, wherein the retainer is adapted for being engaged to the plate element for transmitting at least a part of the climbing force from the plate element to the supporting element.

11. The heel elevator device of one claim 10, wherein the force transmitting piston is coupled to the retainer in such a way that the position of the retainer with respect to the supporting element is adjusted by the position of the force transmitting piston in the engagement position.

12. The heel elevator device of claim 11, wherein the plate element comprises the receiving section with at least two recesses, wherein the recesses are adapted for engaging the retainer, wherein depending on the position of the retainer with respect to the supporting element, the retainer engages with an assigned one of the recesses.

13. The heel elevator device of claim 12, wherein each of the recesses comprises a guiding surface, wherein the guiding surface is formed in such a way that during engagement of the retainer with an assigned one of the recesses and before the climbing force is exerted from the plate element to the retainer, the retainer is rotatable around the retainer rotating axis.

14. The heel elevator device of claim 13, wherein the retainer comprises a long hole with a guide slot, wherein the force transmitting piston is coupled slideably to the guide slot, wherein the guide slot is formed in such a way that a movement of the force transmitting piston in the guide slot in the direction to the supporting element is limited, and wherein the guide slot is formed in such a way that by a movement of the retainer in the direction to the plate element, the guide slot lifts the force transmitting piston for decoupling the force transmitting piston with the rolling body.

15. The heel elevator device of claim 14, further comprising a torsion spring connected to the supporting element, wherein the torsion spring is adapted for exerting a torsional force to the retainer for rotating the retainer around the retainer rotating axis.

16. The heel elevator device of claim 10, further comprising a further spring, wherein the further spring is connected between the retainer and the force transmitting piston, wherein the further spring is adapted for exerting a spring load to the retainer and the force transmitting piston in such a way, that a defined position between the retainer and the force transmitting piston is adjustable.

17. The heel elevator device of claim 16, wherein the further spring is connected between the retainer and the force transmitting piston in such a way, that when the plate element and the retainer are disengaged, the spring load of the further spring exerts the engagement force, so that the force transmitting piston moves slidably into the engagement position, and when the climbing force is transmitted by the retainer to the supporting element, the force transmitting piston is moved into a releasing position by a further spring load of the further spring.

18. The heel elevator device of claim 17, wherein the torsion spring and the further spring are adjusted relatively to each other in such a way, that when the plate element and the retainer are disengaged, the torsion spring forces the retainer to rotate in a first direction, so that the rotation of the retainer in the first direction affects the further spring in such a way that the spring load of the further spring exerts the engagement force to the force transmitting piston and the force transmitting piston is moved in the engagement position, and when the climbing force is exerted, the retainer is rotated by the plate element in a second direction opposed to the first direction, so that the torsion spring is pretensioned and the further spring exerts a further spring load for disengaging the force transmitting piston with the rolling body, so that the rolling body is movably supported in the supporting element.

19. A ski binding system comprising:

a heel elevator device according to claim 1, a ski binding attached to the plate element, wherein the heel elevator device is adapted to be fixed to the ski, wherein the heel elevator device is adapted to align the plate element to the ski with the fixed minimum climbing angle, wherein the climbing angle depends on an inclination of a hill to which the ski aligned parallel thereto.

20. Method of aligning a plate element to a ski, the method comprising:

slidably moving a force transmitting piston into an engagement position in such a way that a piston engaging section is engaged with a gravity based positioning element when a climbing force is exerted to the force transmitting piston by the plate element, spatially fixing the gravity based positioning element by the force transmitting piston in the engaged position for fixing the plate element in a fixed minimum climbing angle with respect to the ski, wherein the minimum climbing angle corresponds to a position of the gravity based positioning element with respect to the supporting element, and slidably moving the force transmitting piston into an disengagement position when a load releasing force is exerted to the plate element in such a way that the piston engaging section is disengaged with the gravity based positioning element, so that the gravity based positioning element is movably fixed to the supporting element, aligning the gravity based positioning element to gravity in the disengagement position.

* * * * *